US007374271B2

(12) United States Patent
Umeda

(10) Patent No.: US 7,374,271 B2
(45) Date of Patent: May 20, 2008

(54) CAP AND DROPLET DISCHARGE APPARATUS

(75) Inventor: Takaichiro Umeda, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 333 days.

(21) Appl. No.: 11/044,349

(22) Filed: Jan. 28, 2005

(65) Prior Publication Data

US 2005/0168519 A1 Aug. 4, 2005

(30) Foreign Application Priority Data

Jan. 30, 2004 (JP) ..... 2004-024089

(51) Int. Cl.
*B41J 2/165* (2006.01)

(52) U.S. Cl. ..... 347/20; 347/33

(58) Field of Classification Search ..... 347/29–35
See application file for complete search history.

(56) References Cited

U.S. PATENT DOCUMENTS 5,424,768 A 6/1995 Dudek et al. ..... 347/29
5,426,456 A * 6/1995 Kuelzer et al. ..... 347/30

FOREIGN PATENT DOCUMENTS

| | | |
|---|---|---|
| JP | A-04-070355 | 3/1992 |
| JP | A-07-025018 | 1/1995 |
| JP | A-2002-103594 | 4/2002 |
| JP | A-2002-127440 | 5/2002 |

* cited by examiner

*Primary Examiner*—Juanita D. Stephens
(74) *Attorney, Agent, or Firm*—Oliff & Berridge, PLC

(57) ABSTRACT

A cap capable of sealing a nozzle by two methods and a droplet discharge apparatus using the cap. When the cap is pressed onto a nozzle surface with the nozzle aligned with a center of a covering portion, a lip continuously contacts the surrounding of an opening of the nozzle, thereby forming a sealed space on the surface formed with the opening of the nozzle. Although ink in the nozzle may dry when left for a long time, no influence on ink discharge operation immediately after the cap is detached is expected since the cap does not directly seal the opening. When the cap is pressed onto the nozzle surface with the nozzle aligned with a center of a sealing portion, the substantially flat sealing portion seals the opening, thereby effectively preventing drying of ink, although there may be an influence on discharge operation immediately after the cap is detached.

17 Claims, 31 Drawing Sheets

CAP AND DROPLET DISCHARGE APPARATUS

BACKGROUND OF THE INVENTION (i) Field of the Invention

The present invention relates to a cap for sealing a nozzle for discharging droplets and a droplet discharge apparatus provided with a head capable of selectively discharging droplets from the nozzle as well as the cap.

(ii) Background Art

A known example of a conventional droplet discharge apparatus of this type is a so-called on-demand-type inkjet printer provided with a head capable of selectively discharging ink in droplets from a nozzle. In such an inkjet printer, the nozzle is sealed with a cap to prevent the ink in the nozzle from drying or becoming solidified during a standby time when the ink is not discharged. There are known caps, such as a cap of one type that directly seals an opening of a nozzle, and a cap of another type that has a lip closely contacting a circumference of an opening of a nozzle continuously and forms a sealed space on the surface formed with the opening of the nozzle by the close contact of the lip. It is also suggested to have caps of the both types at the same time, as disclosed in the Publication of Japanese Unexamined Patent Application No. 2002-103594.

SUMMARY OF THE INVENTION

While a cap of the former type that directly seals an opening of a nozzle is highly effective to prevent drying of ink, there is a possibility that direct sealing of the opening of the nozzle with the cap may exert an influence on discharge operation immediately after the cap is detached.

In contrast, a cap of the latter type forming a sealed space on the surface formed with the opening of the nozzle presents a possibility of causing drying of ink when left for a long time due to the sealed space having a certain volume defined on the surface formed with the opening of the nozzle. However, the cap of the latter type, which does not at all contact the surface formed with the opening of the nozzle, will not exert an influence on discharge operation when left for a short time.

Accordingly, by using caps of the two types appropriately depending on the standby state of a head (e.g. the length of the standby time), an improved discharge performance of the head may be achieved.

However, providing both caps of the two types, as disclosed in the Publication of Japanese Unexamined Patent Application No. 2002-103594, will lead to an increased number of components, thereby to an increased manufacturing cost of a droplet discharge apparatus, and to an increase in size of the droplet discharge apparatus. The present invention has been made with the object of providing a cap capable of sealing a nozzle by the above described two methods without causing a cost increase or an increase in size of a droplet discharge apparatus, and providing a droplet discharge apparatus using the cap.

To attain the above object, there is provided a cap for sealing a nozzle for discharging droplets of a liquid, which comprises: a sealing portion that directly seals an opening of the nozzle; and a covering portion having a lip continuously and closely contacting a surrounding of the opening of the nozzle, the covering portion being adapted to form a sealed spate on a surface formed with the opening of the nozzle by the close contact of the lip. The sealing portion and the covering portion are integrally formed adjacent to each other.

According to one aspect of the present invention configured as above, when the sealing portion is brought to directly seal the opening of the nozzle, drying of ink may be effectively prevented, although there is a possibility that direct scaling of the opening of the nozzle may exert an influence on discharge operation immediately after the cap is detached. When in contrast, the covering portion is brought to closely contact the surrounding of the opening of the nozzle, an influence on discharge operation may be avoided due to no direct sealing of the opening of the nozzle, although there is a possibility of drying of ink when left for a long time. In the cap of the present invention provided with the sealing portion and the covering portion formed integrally with each other, an improved discharge performance of the head can be achieved by appropriately using one of the two portions depending on the standby state of the head having the nozzle (e.g. the length of the standby state).

According to one aspect of the present invention, in which the sealing portion and the covering portion are formed integrally with each other, an increase in the number of components and a resulting increased manufacturing cost, or an increase in size of a droplet discharge apparatus will not be caused. Therefore, the cap of the present invention is capable of sealing a nozzle by the above described two methods without causing a cost increase or an increase in size of a droplet discharge apparatus.

In another aspect of the present invention, there is provided a droplet discharge apparatus. The droplet discharge apparatus comprises a head capable of selectively discharging droplets of a liquid from a nozzle, a cap according to the present invention as described above, a moving device that moves the cap relatively to the head in a predetermined direction in which the sealing portion and the covering portion are arranged adjacent to each other, and a control device that selects one of the sealing portion and the covering portion depending on a standby state in which the head does not discharge the droplets from the nozzle, drives the moving device to move the cap relatively to the head, and brings the sealing portion, if selected, to directly seal an opening of the nozzle or brings the covering portion, if selected, to closely contact a surrounding of the opening of the nozzle.

According to another aspect of the present invention configured as above, the control device may select one of the sealing portion and the covering portion depending on the standby state of the head, in which the head does not discharge droplets from the nozzle. The control device drives the moving device to move the cap relatively to the head such that a selected one of the sealing portion and the covering portion faces the nozzle, and brings the sealing portion, if selected, to directly seal an opening of the nozzle or brings the covering portion, if selected, to closely contact a surrounding of the opening of the nozzle. Therefore, an improved discharge performance of the head may be achieved in the present invention, by using the sealing portion and the covering portion appropriately depending on the standby state of the head. In addition, an increase in the number of components and a resulting increased manufacturing cost, or an increase in size of a droplet discharge apparatus will not be caused since the sealing portion and the covering portion are formed integrally with each other as described above.

BRIEF DESCRIPTION OF THE DRAWINGS

A preferred embodiment of the present invention will now be described with reference to the drawings, in which.

DETAILED DESCRIPTION OF THE PREFERRED EMBODIMENT

Figure 1:
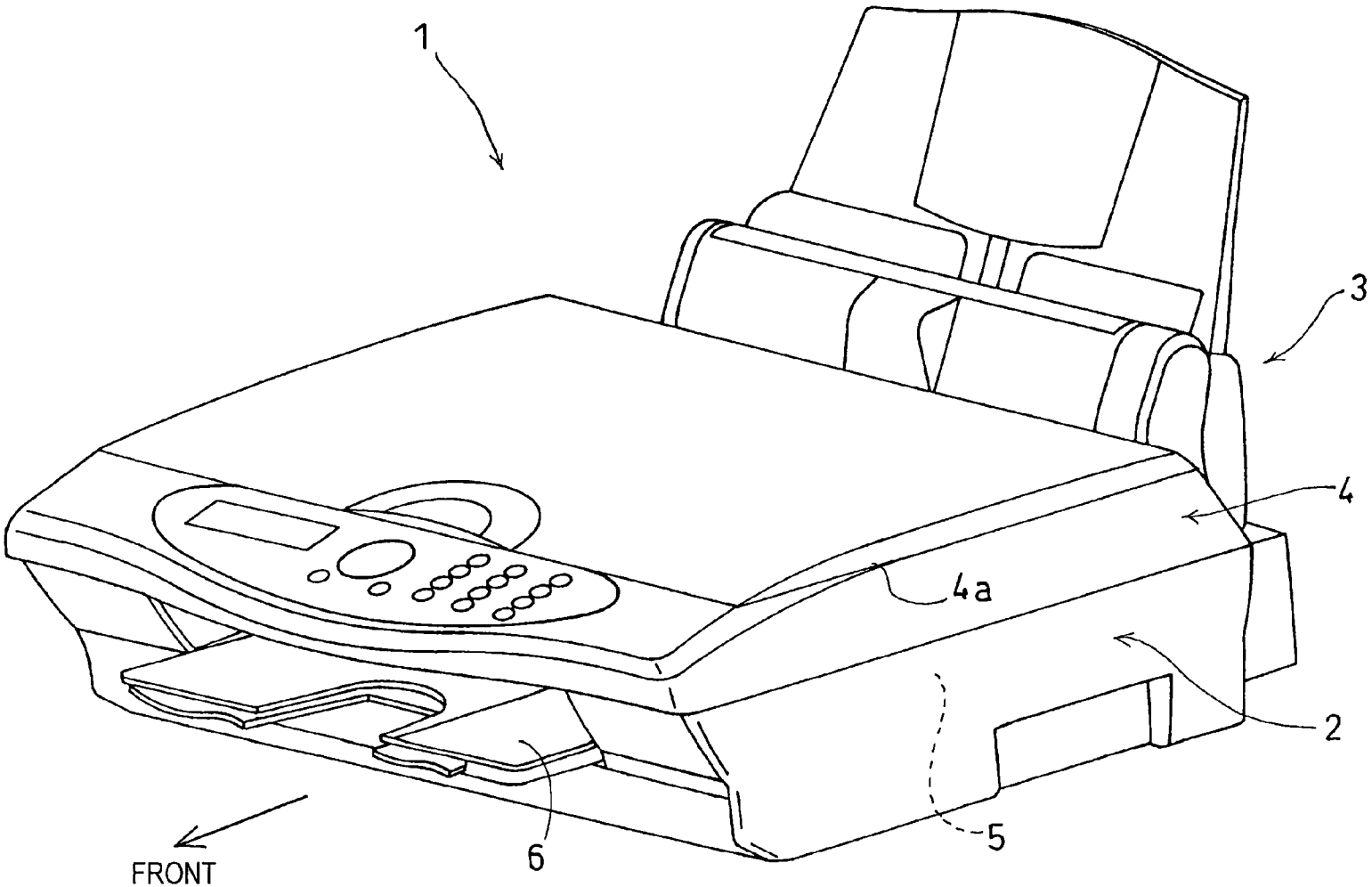
FIG. 1 is a perspective view of an inkjet printer according to the present invention.

In the present embodiment, the present invention is applied to a multi-function apparatus (MFC: Multi-Function Center) 1 equipped with a printer function, a copier function, a scanner function and a facsimile function. As shown in FIG. 1, a paper feeder 3 is provided at a rear end of a main housing 2 of the apparatus, and a document reading unit 4 for the copier function and the facsimile function is provided on an upper side in front of the paper feeder 3. An inkjet printer 5 (to be hereinafter described) for serving the printer function is provided under the entire lower surface of the document reading unit 4. A paper exit tray 6 for receiving recording media, such as a sheet of paper P (not shown) to be discharged after recording (printing), is provided in front of the inkjet printer 5.

The document reading unit 4 is designed, although not-shown, to be pivotable up and down around a horizontal shaft at its rear sad portion. When a cover 4*a* is opened upward, there is provided a mounting glass plate for mounting a document thereon, and an image scanner unit for reading tho document under the mounting glass plate.

Figure 2:
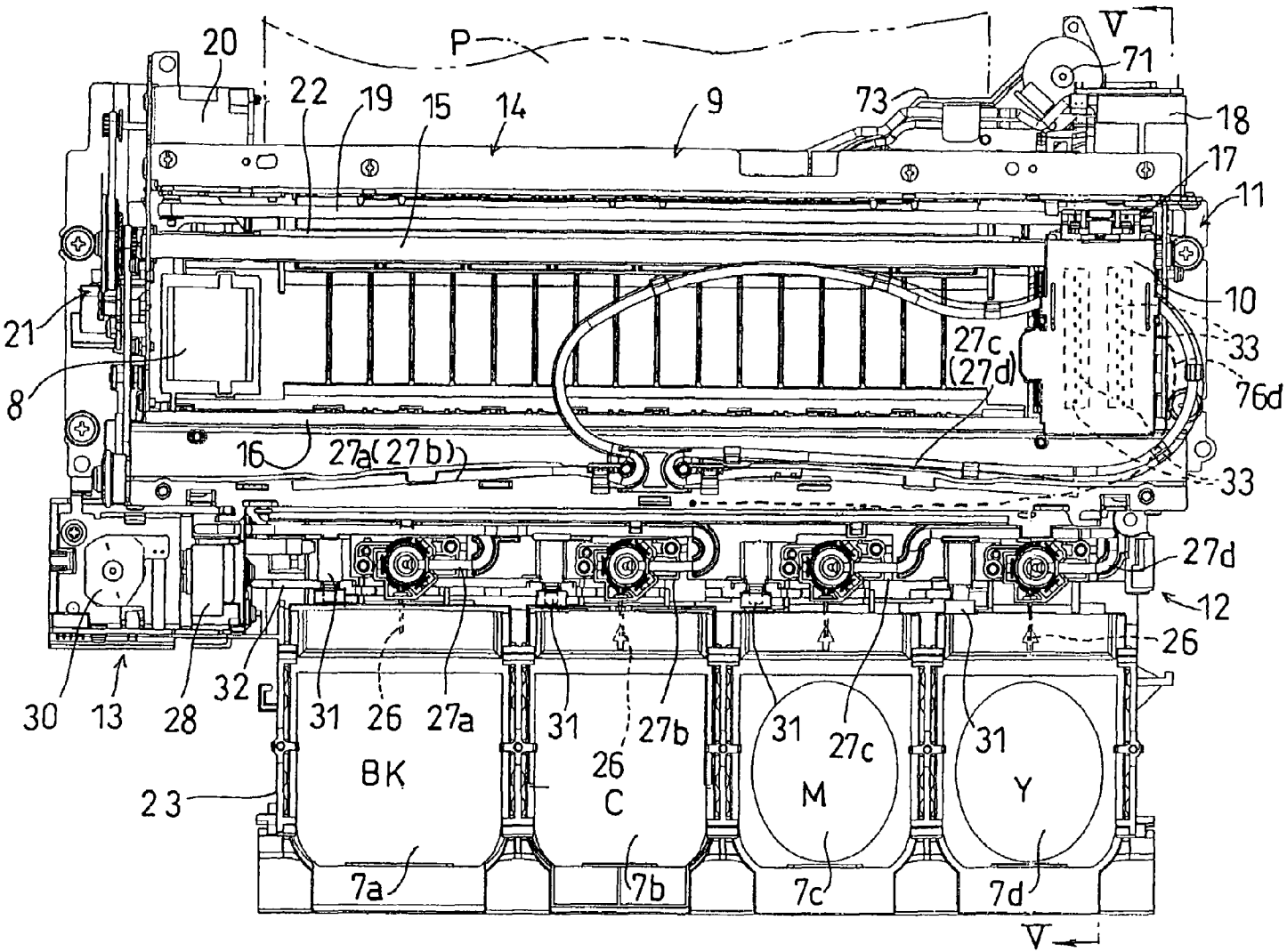
FIG. 2 is a plan view of a printing mechanism of the inkjet printer.

When the entire document reading unit 4 is opened upward, an ink cartridge 7 serving as an ink tank (specifically ink cartridges 7*a* through 7*d* for respective colors of black, cyan, magenta and yellow; see FIG. 2) can be replaced for use in the inkjet printer 5 for full-color recording, and maintenance of a recording head unit 10 can be performed.

Next, the schematic configuration of the inkjet printer 5 will be described with reference to FIGS. 2 through 5. The inkjet printer 5 includes a printing mechanism portion 9, a maintenance unit 11, an ink supply portion 12, and an air supply portion 13. The printing mechanism portion 9 is housed in a body frame 14 and ejects ink onto paper P as a recording medium to thereby perform recording. The maintenance unit 11 performs maintenance processing of the recording head unit 10 in the printing mechanism portion 9. The ink supply portion 12 supplies ink from the ink cartridges 7*a* through 7*d* to the recording head unit 10. The air supply portion 13 supplies pressurized (positively pressurized) air to the ink cartridges 7*a* through 7*d*.

Figure 3:
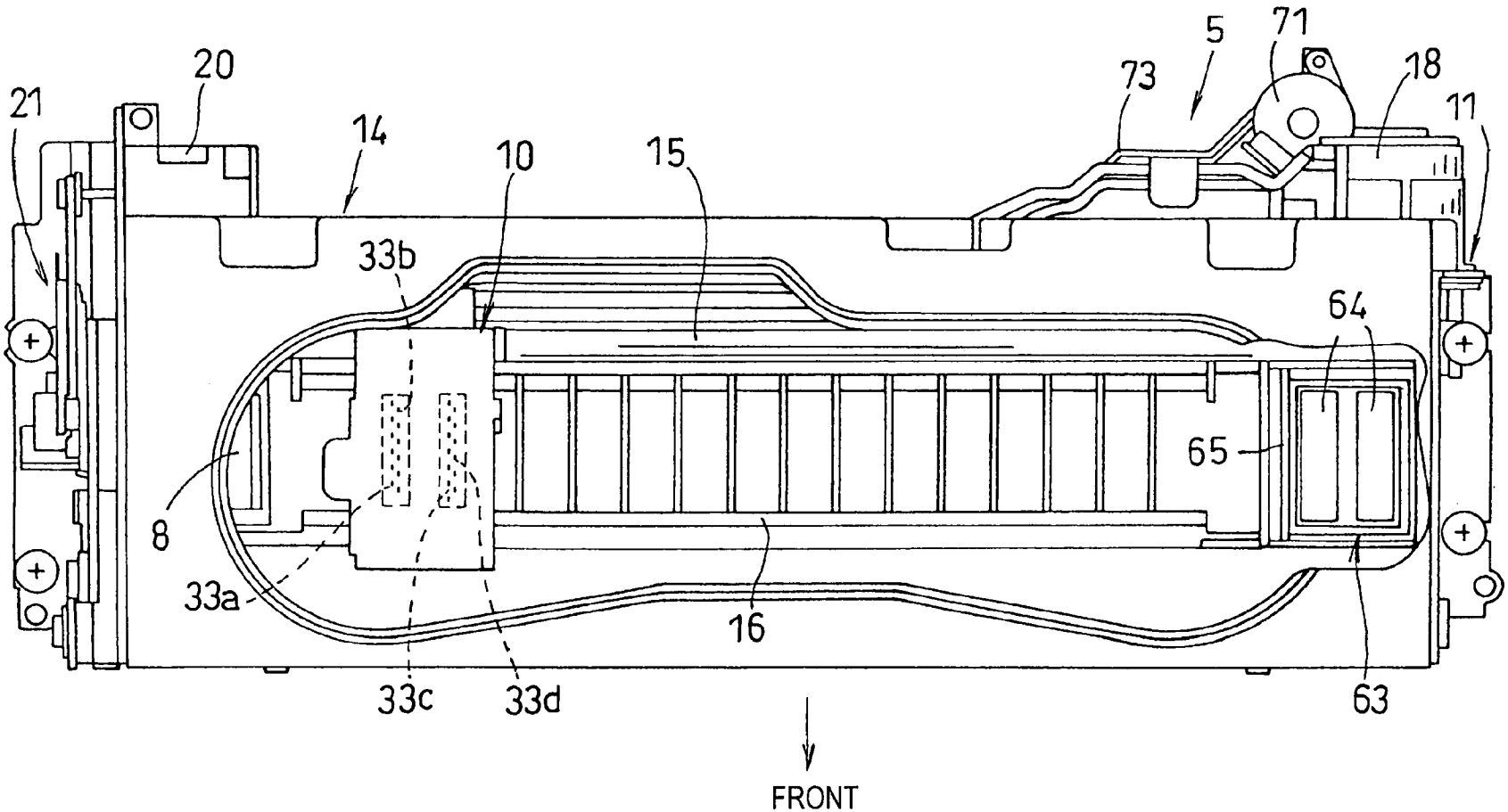
FIG. 3 is a plan view of a main body frame of the inkjet printer.
Figure 5:
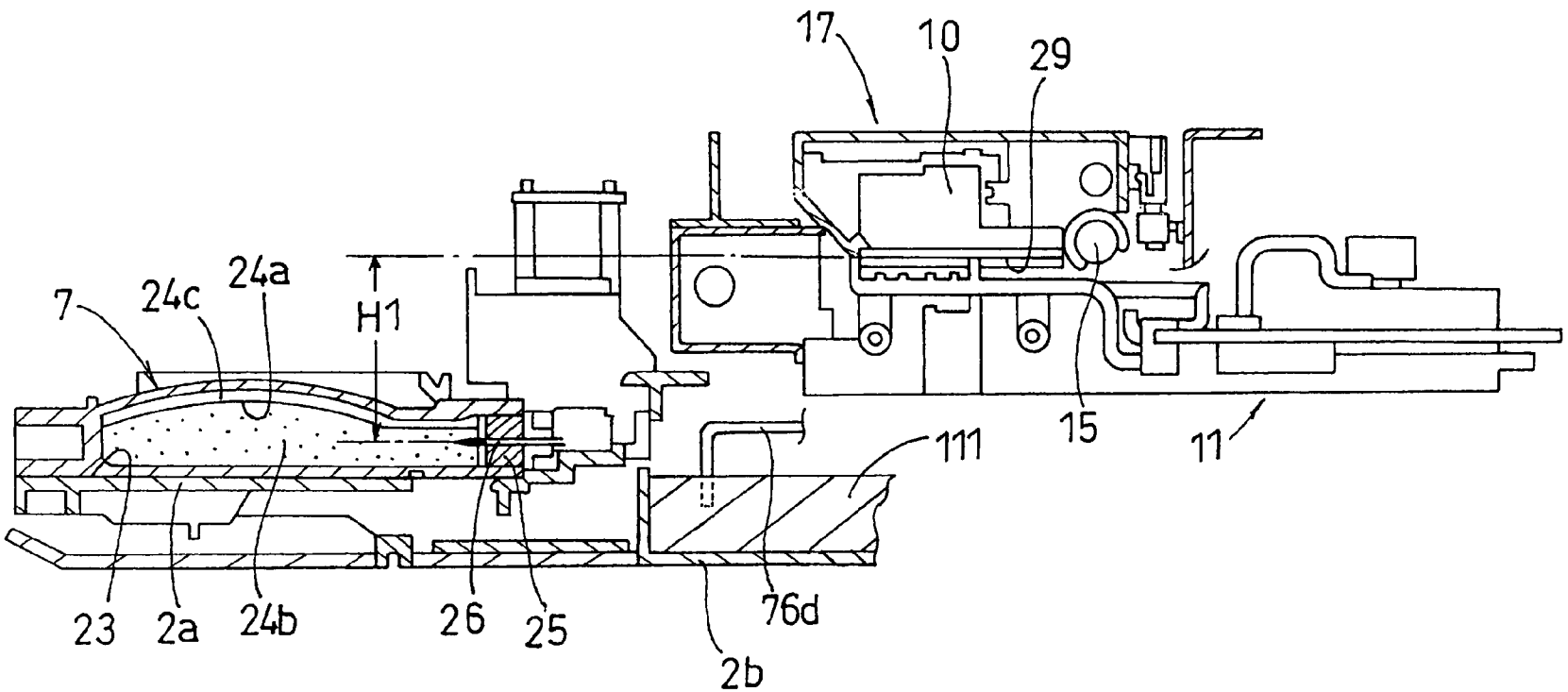
FIG. 5 is a cross-sectional view seen in the direction of arrows from line V-V of FIG. 2.

The printing mechanism portion 9 and the maintenance unit 11 are housed in a box-shaped body frame 14 having a substantially elliptic opening in its upper portion, as shown in FIGS. 2, 3 and 5. A carriage 17 is slidably mounted on a rear guide shaft 16 and a front guide shaft 16 extending in the right and left direction and provided in parallel with each other in the body frame 14. The recording head unit 10 is mounted on the carriage 17 by integrally attaching the same.

The carriage 17 is designed to be reciprocable in the right and left direction along the front and rear guide shafts 16 and 15 by a carriage drive motor 18 disposed on the right rear side of the body frame 14 and a timing belt 19 which is an endless belt (see FIG. 2).

A main conveyor roller 22 located under the rear guide shaft 15 (see FIG. 2) and a not-shown conveyor roller located under the front guide roller 16 convey the sheet of paper P horizontally under the lower surface of the recording head unit 10, through a paper feed motor 20 disposed on the left rear side of the body frame 14 and a transmission mechanism 21, including a belt and gears, disposed on the left side of the body frame 14. The sheet of paper P, on which recording has been performed, is conveyed in the direction of the paper exit tray 6.

Outside the width of the sheet of paper P to be conveyed, an ink receiving portion 8 is provided on one end side (the left end side in FIGS. 2 and 3 in the present embodiment), and the maintenance unit 11 is disposed on the other end side. The recording head unit 10 regularly performs ink ejection for prevention of nozzle clogging during recording operation at a flushing position at which the ink receiving portion 8 is disposed, and the ejected ink is received by the ink receiving portion 8. The maintenance unit 11 disposed at a head standby position on the other end side performs cleaning of a nozzle surface 29, recovery processing for selectively sucking ink for each color and after-described removing processing for removing air from a buffer tank 36.

The configuration of the ink supply portion 12 will next be described. As shown in FIG. 5, a cartridge attachment portion 23 is provided below the conveying path of the sheet of paper P and in the front portion on the upper surface of a lower partition plate 2*a* of the main housing 2. The cartridge attachment portion 23 is designed such that ink cartridge 7 for each color can be attached by insertion from the front direction at a lower position than the nozzle surface 29 provided on the lower surface of the recording head unit 10. As shown in FIG. 2, the black (BK) ink cartridge 7*a*, the cyan (C) ink cartridge 7*b*, the magenta (M) ink cartridge 7*c*, the yellow (Y) ink cartridge 7*d* are aligned in this order from the left and also horizontally.

A membrane 24*a* having flexibility is applied to substantially the entire inner surface of the ink cartridge 7, thereby dividing the inside of the ink cartridge 7 into an ink reservoir chamber 24*b* on the lower side and an air chamber 24*c* on the upper side. A rear wall of the ink cartridge 7 is provided with an air vent hole (not-shown) formed therein for communicating the air chamber 24*c* with the atmosphere, and with a seal member 25 of silicone or the like attached for separating the ink reservoir chamber 24*b* from the outside.

An ink needle 26 is provided at the rear of each of the cartridge attachment portions 23 so as to project horizontally and opposite to the inserting direction of the ink cartridge 7 (i.e. toward the rear wall of the ink cartridge 7). The proximal end portion of each of the ink needles 26 for each color is connected to the recording head unit 10 through a corresponding flexible ink supply tube 27*a*, 27*b*, 27*c* or 27*d*, as shown in FIG. 2. The middle portions of the ink supply tubes for black and cyan 27*a* and 27*b*, and the middle portions of the ink supply tubes for magenta and yellow 27*c* and 27*d* are bundled, respectively, in a stacking manner.

As shown in FIG. 6, the nozzle surface 29 in the recoding head unit 10 is located at a position higher than the position of the ink needles 26 by a water head HI. An air pump 28 of a diaphragm-type or the like in the air supply portion 18 and four pressure-contact pads 31 projecting forward in parallel with the respective ink needles 26 are connected with an air tube 32. Each of the pressure-contact pads 31 is retained in a close contact with the air vent hole in the rear wall of the ink cartridge 7, inserted and fixed to the cartridge attachment portion 23, by a biasing force of a biasing spring. Then, the air pump 28 is driven by the drive motor 30 to supply pressured (positively pressured) air to the air chamber 24*c* of each of the ink cartridges 7*a* through 7*d*, so that a positive pressure is applied to the ink in the ink reservoir chamber 24*b*, thereby to supply ink to the recording head unit 10 located at a position higher by a water head H1.

The configurations of the recording head unit 10 mounted on the carriage 17 and the opening/closing valve device 41 will now be described, with reference to FIGS. 3, 6A through 11B. In the present embodiment, as shown in FIGS. 3, 6A, 6B and 10, the recording head unit 10 includes recording heads 34 (four recording heads in the present embodiment) having rows of nozzles 33*a* through 33*d* for respective colors, an actuator 35 such as a flat piezoelectric element joined on the upper surface of each of the recording heads 34, a buffer tank 36 having air reservoir chambers 40 and a case 37 having an opening/closing valve device 41 adjacent to a lateral surface of the buffer tank 36.

Figure 8:
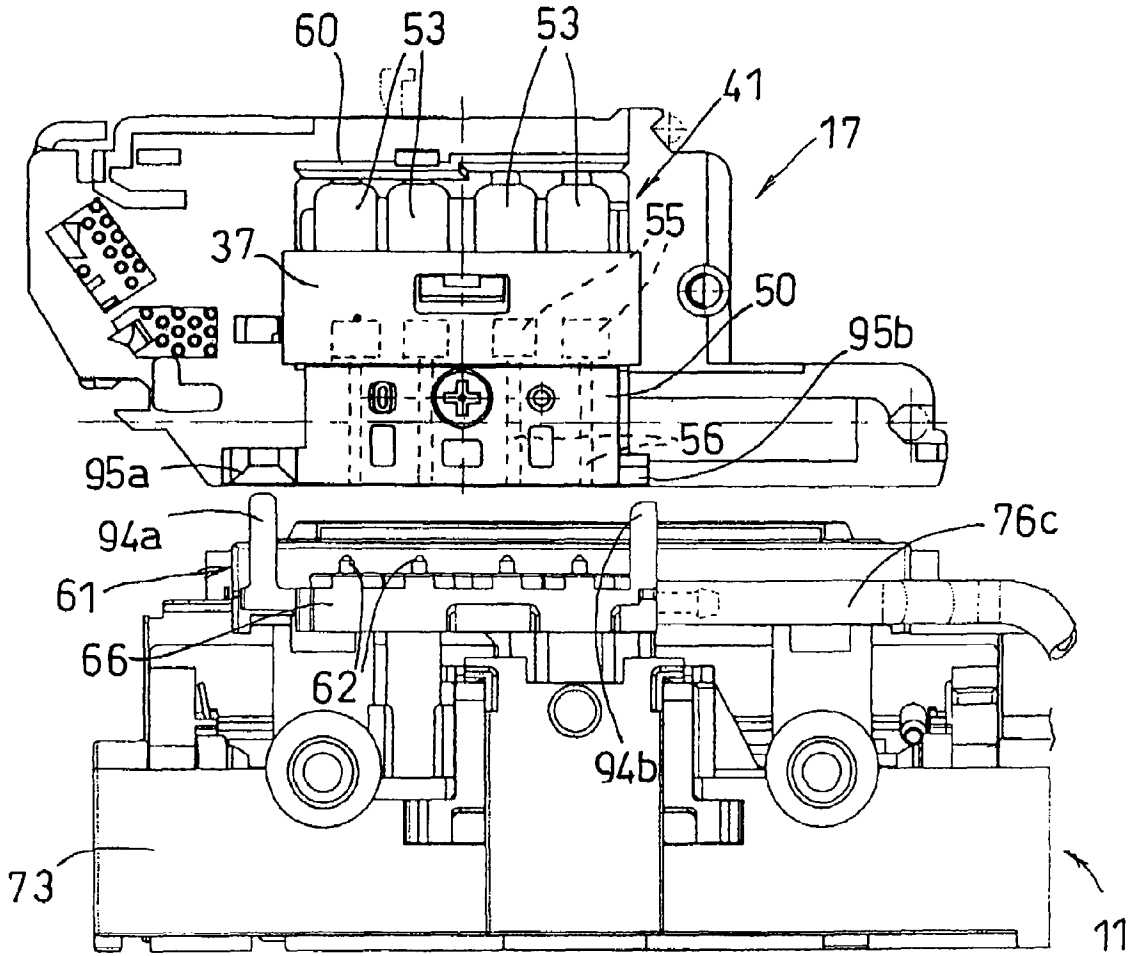
FIG. 8 is a side elevational view of the carriage and a maintenance unit seen in the direction of arrows from line VIII-VIII of FIG. 12.
Figure 9:
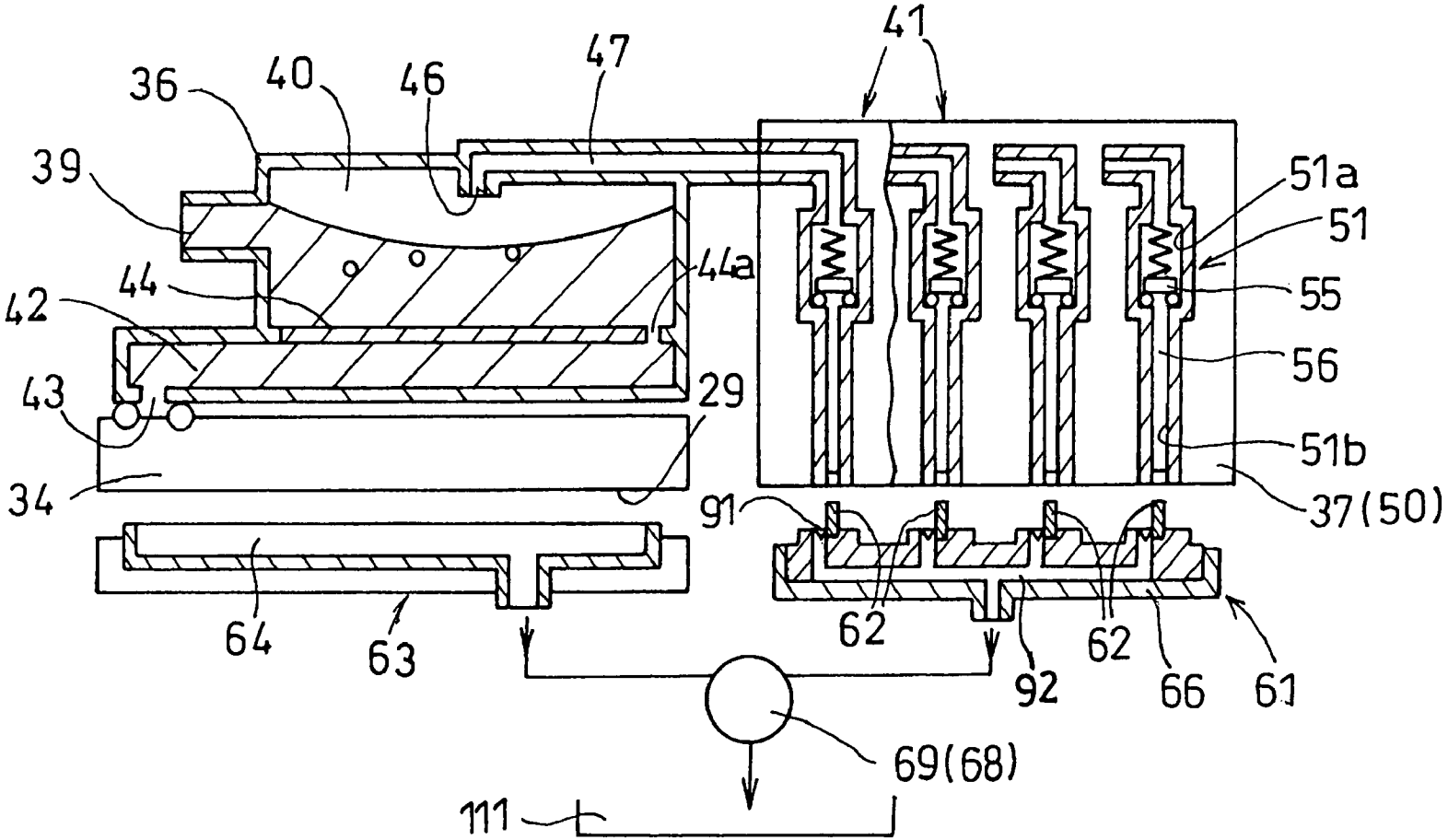
FIG. 9 is a diagrammatic cross-sectional view of a device that removes air in an air reservoir chamber.

As shown in FIG. 8, a row of nozzles 33*a* for black (BK), a row of nozzles 33*b* for cyan (C), a row of nozzles 33*c* for magenta (M) and a row of nozzles for yellow (Y) are formed under the recording heads 34 so as to extend in a direction perpendicular to the moving direction of the carriage 17. The nozzles 33*a* through 33*d* are exposed downward so as to face the upper surface of the sheet of paper P. The recording heads 34 distribute ink supplied from the buffer tank 86 to pressure chambers for respective nozzles, so as to eject ink through the nozzles by an actuator 35 such as a piezoelectric element corresponding to the respective pressure chambers, in the same manner as a known recording head.

In FIG. 2 and FIG. 8, the nozzles 33*a*, 33*b*, and the nozzles 33*c*, 33*d* are indicated apart from each other at a larger distance than the actual distance for illustration purpose only. The nozzles 33*a*, 33*b*, as well as the nozzles 33*c*, 33*d*, which are disposed in a zigzag manner as shown in the figures, are actually apart from each other at an extremely short distance and therefore appear to be disposed in a straight line.

Figure 10:
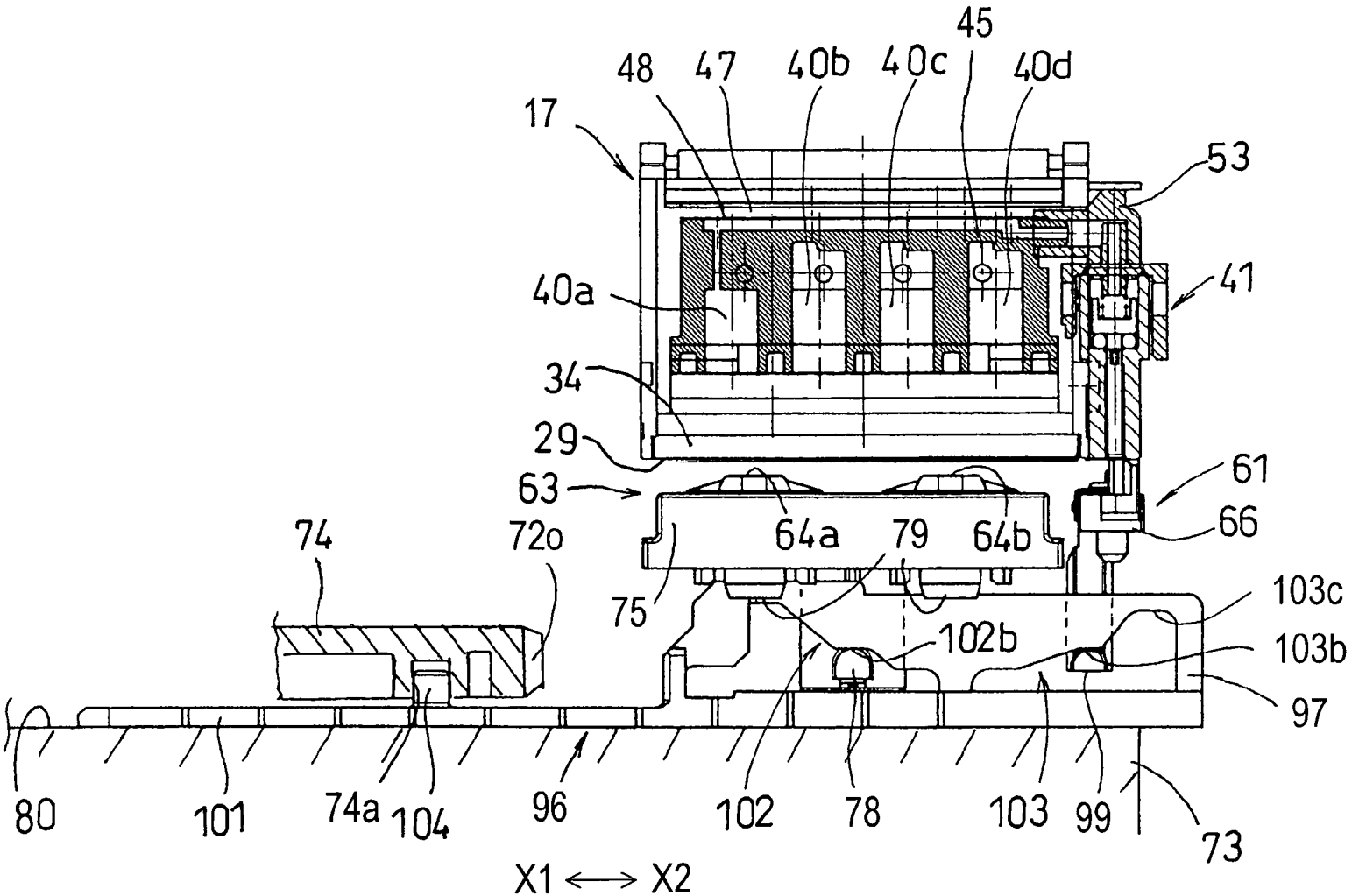
FIG. 10 is a side elevational view showing respective positions of the carriage, a parallel motion cam, a recovery device and an air removal device in a standby state.

The buffer tank 36 having the air reservoir chambers 40 defined for respective colors (individually indicated by 40*a*, 40*b*, 40*c* and 40*d*; see FIG. 10) is formed of a synthetic resin into a substantially rectangular shape in a plan view. The buffer tank 36 has, in one lateral side face, ink inlets 39 (four ink inlets in the present embodiment) projecting in a horizontal direction so as to be connected with joint members 38 (details are omitted) coupled to the respective ends of the ink supply tubes 27*a* through 27*d* for respective colors.

Ink is supplied to the recording head 34 from an ink flow chamber 42 at the bottom of the buffer tank 36 through a downward outlet portion 43. A filter 44 substantially dividing the lower portion of the air reservoir chamber 40 and the ink flow chamber 42 substantially horizontally is formed of a reticular mesh of stainless steel wires.

The filter 44 allows an ink flow at a slow speed during recording operation from the air reservoir chamber 40 into the ink flow chamber 42, while preventing air or dust included in the ink from flowing with the ink flow through the filter 44 toward the recording head 84. The filter 44 is also provided with an opening 44*a*, at a distal end from the ink inlet 39, having a flow passage resistance sufficiently low compared with the flow passage resistance of the mesh of the filter 44. Accordingly, the filter 44 ensures a sufficient ink flow to the ink flow chamber 42 through the opening 44*a* with respect to an ink flow at a high speed during after-described recovery purge processing operation.

Figure 6A:
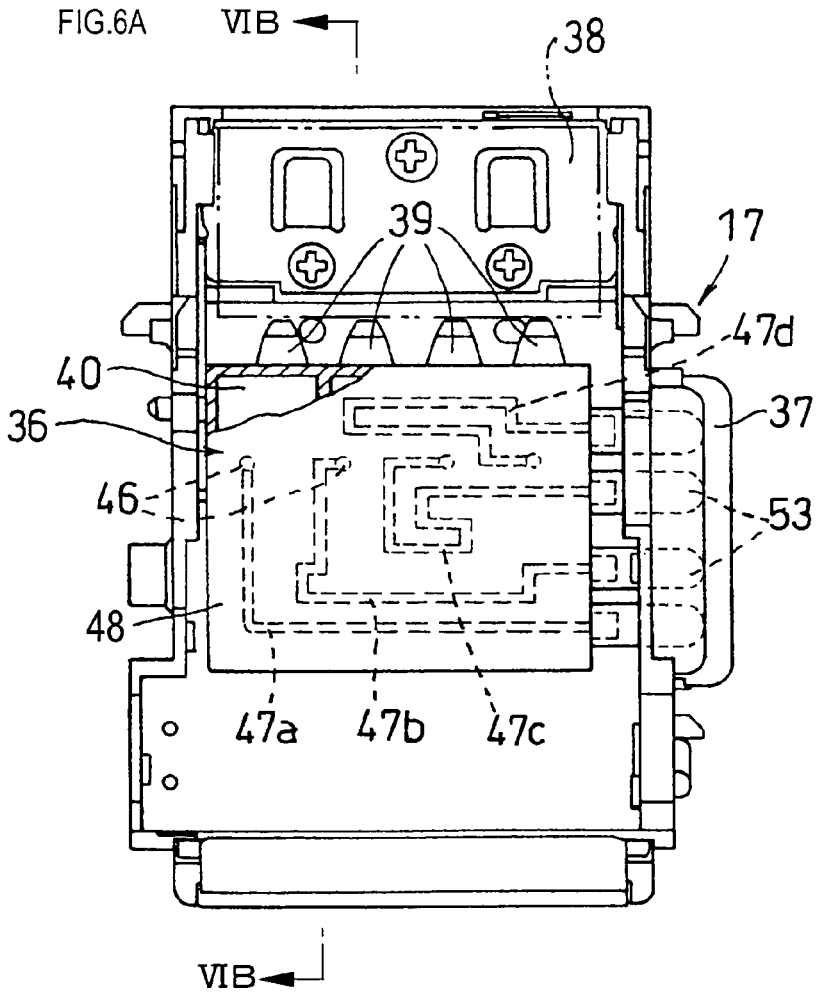
FIG. 6A is a plan view of a carriage provided with a buffer tank and others.
Figure 6B:
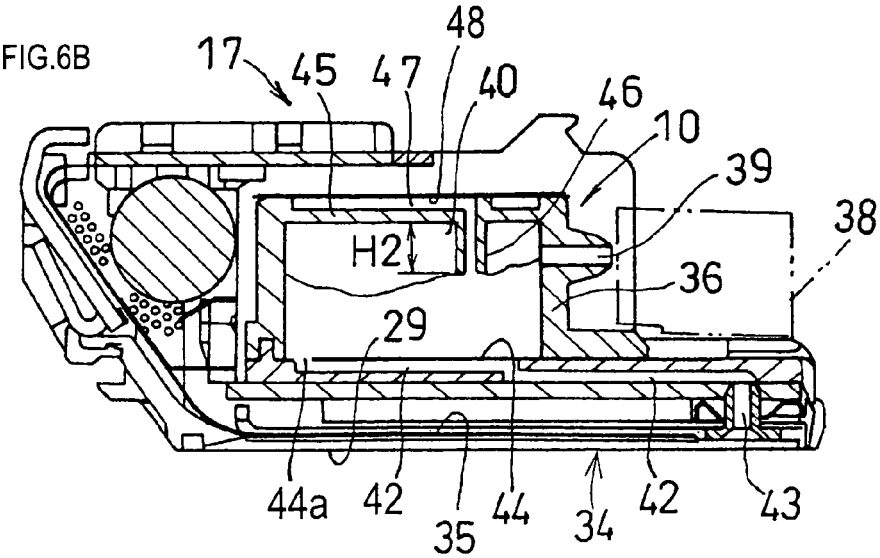
FIG. 6B is a cross-sectional view seen in the direction of arrows from line VIB-VIB of FIG. 6A.
Figure 7:
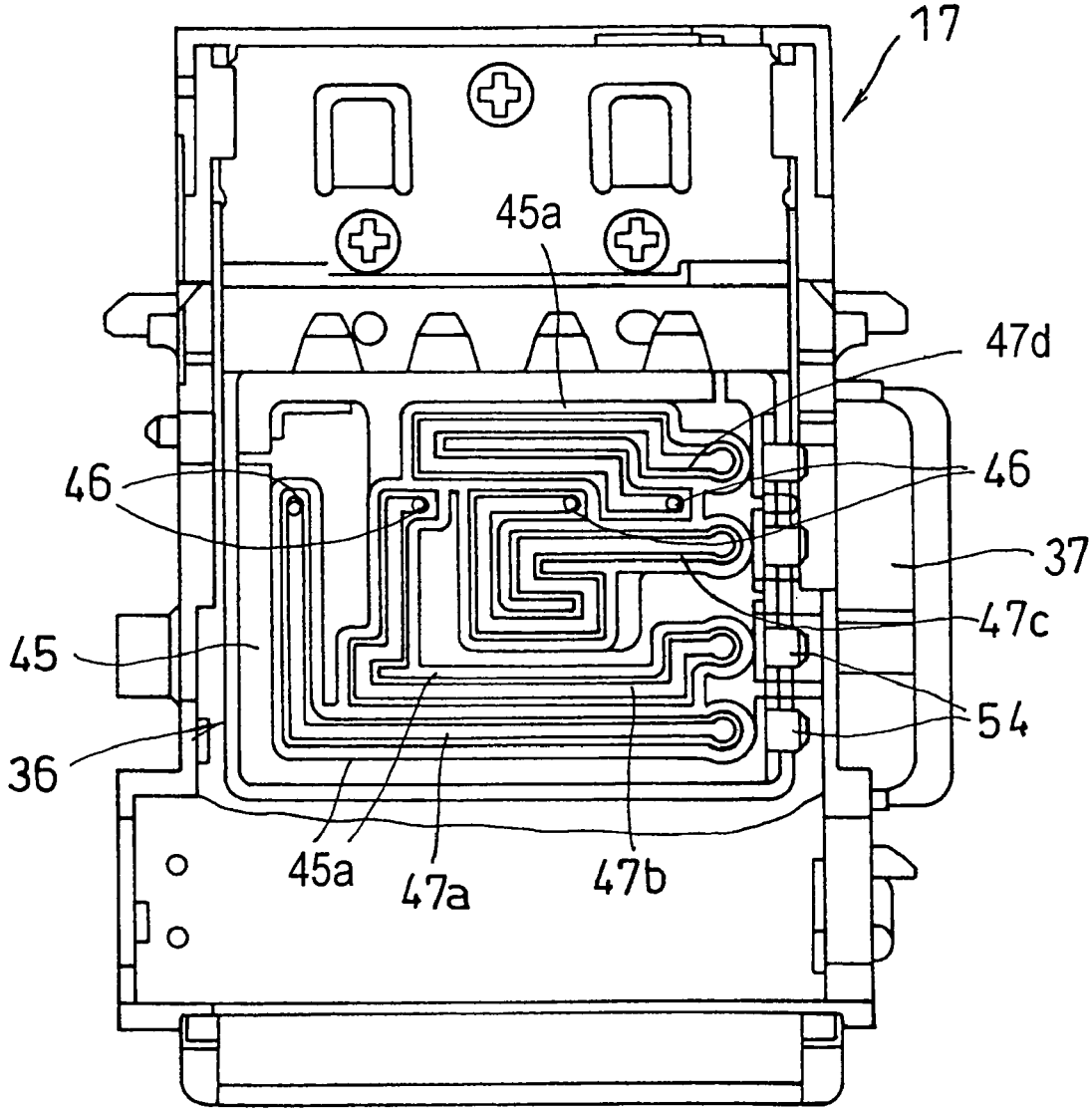
FIG. 7 is a plan view showing a suction path on an upper surface of the buffer tank.

As shown in FIG. 6A, FIG. 6B and FIG. 7, a top wall 45 of each air reservoir chamber 40 is provided with a cylindrical suction port 46 projecting downward for sucking ink with air. Each suction passage 47 (individually indicated by 47*a* through 47*d*) as an air discharge passage its provided on the top wall 46 such that one end of the suction passage 47 communicates with the suction port 46 and the other end thereof communicates with the after-described inlet portion of the case 37.

In a conventional configuration, when sucking ink from the nozzles and air from the air reservoir chambers 40 at the same time during recovery purge operation, a large suction force is required to prevent narrow ink passages in the recording head 34 from being clogged with air. In addition, a large amount of ink corresponding to substantially the entire ink in the buffer tank 36 must be discharged, that is, thrown away, in order to suck air residing above the ink. This leads to an increased running cost of the inkjet printer.

In the present embodiment, since the air accumulated in the air reservoir chamber 40 of the upper portion of the buffer tank 36 is removed from the upper portion of the buffer tank 38, specifically from the top wall 45, the air will not flow into the recording head 34 located below. Accordingly, a problem that any ink flow passage in the recording head 34 is clogged with air will not occur. Also, it is unnecessary to discharge a large amount of ink retained in the buffer tank 36 when removing air from the buffer tank 36. This leads to a reduced running cost, and therefore achieving an economical advantage.

In the present embodiment, the suction passages 47*a* through 47*d* are defined between grooves concavely formed in the upper surface of the top wall 45 and a membrane such as a synthetic resin film 48 bonded on the upper surface of the top wall 45. A reference mark 45*a* in FIG. 7 indicates a bonded section with the film 48 formed so as to separate the respective suction passages 47*a* through 47*d* from one another.

As shown in FIG. 6B and FIG. 7, the cross-sectional area of each of the suction passages 47*a* through 47*d* is equal to or smaller than the passage cross-sectional area of the ink inlet 39 of the buffer tank 36 or a tube (not shown) connected thereto. By providing the respective suction passages 47*a* through 47*d* having the same length, substantially the same air flow resistance can be obtained during discharge of the air in the respective air reservoir chambers 40 through the case 37. Also, air discharge operation of the plurality of air reservoir chambers 40 can be completed substantially at the same time.

In addition, an air collecting portion that collects air of an appropriate volume unable to be discharged from the auction port 46 is formed in an upper portion of each of the air reservoir chambers 40, by adjusting a height H2 of downward projection of the cylindrical portion including the suction port 46 therein from a lower surface of the top wall 45. Then, pressure alteration of ink in the air reservoir chambers 40 caused by the movement of the carriage 17 in the light and left direction can be absorbed by the air collecting portions.

The respective suction passages 47*a* through 47*d* have larger ink flow resistances than the air flow resistances due to the cross sectional areas and the lengths of the auction passages 47*a* through 47*d*. Different amounts of air may be retained in the respective air reservoir chambers 40 of the buffer tank 36 divided for inks of four colors. Even when the after-mentioned air discharge operation is performed to all the air reservoir chambers 40 at the same time, once the surface of ink reaches any one suction port 46, air discharge in the other reservoir chambers 40 is to be performed preferentially due to the larger ink flow resistance. Thus, different amounts of air in the air reservoir chambers 40 will not lead to a phenomenon that ink discharge from the buffer tank 36 containing a less amount of air (in other words, a larger amount of ink) is increased unevenly.

Figure 11A:
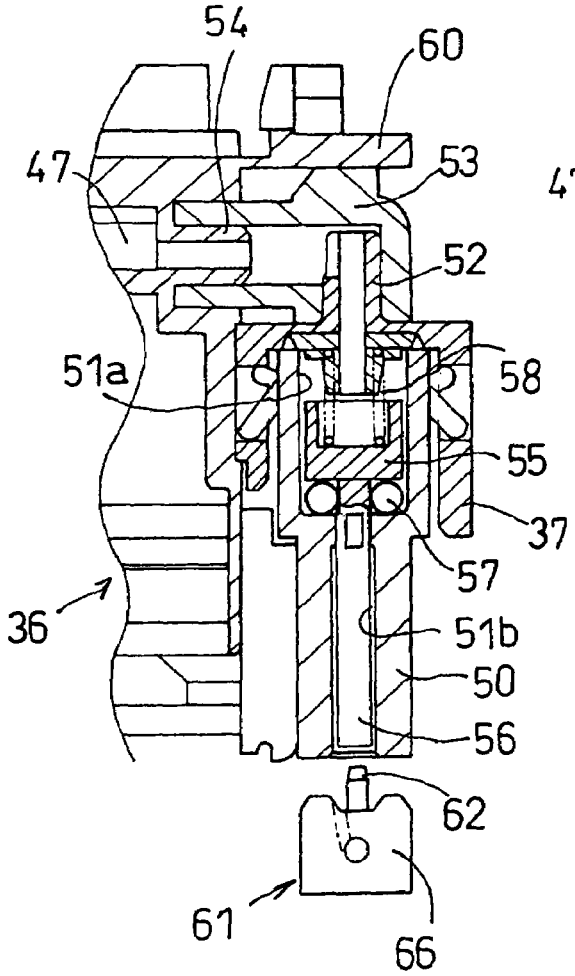
FIG. 11A is a partially enlarged cross-sectional view of an opening/closing valve device in a closed state.
Figure 11B:
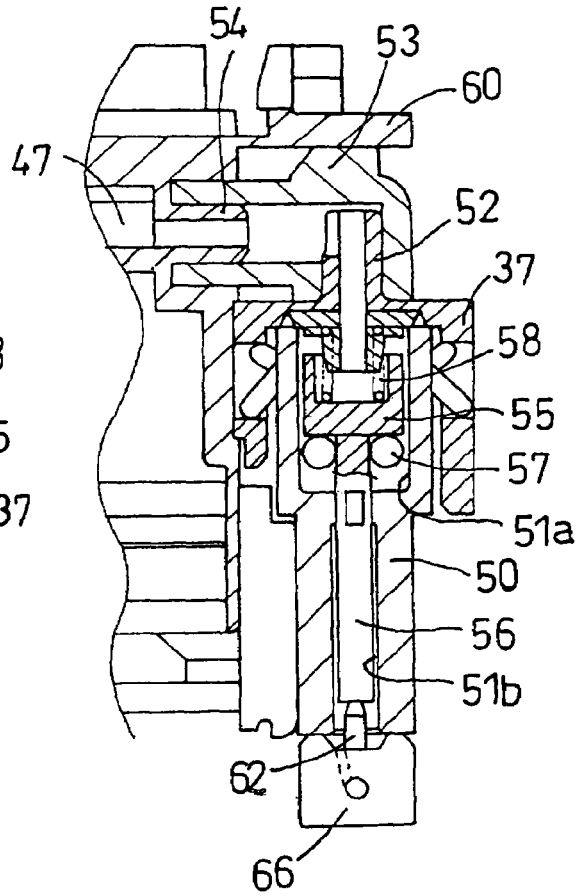
FIG. 11B is a partially enlarged cross-sectional view of an opening/closing valve device in an opened state.

The case 37 in the opening/closing valve device 41 is provided adjacent to one side of the buffer tank 36 (the right side in FIG. 6A. FIG. 7 and FIG. 10). As shown in FIG. 10, FIG. 11A and FIG. 11B, a cylinder block 50 of synthetic resin having a passage hole 51 extending and being open in an upward/downward direction is attached in an air tight manner to the case 37 of synthetic resin. In tho present embodiment, four passage holes 51 are provided side by side corresponding to the respective suction passages 47*a* through 47*d*. Four passage cylinders 52 communicating with upper ends of the respective passage holes 51 project upward from an upper end of the case 37, such that the respective passage cylinders 52 and horizontal outlets 54 of the respective suction passages 47*a* through 47*d* are connected through cap bodies 53 made of flexible rubber or the like. A canopy portion 60 horizontally projecting from an upper portion of the buffer tank 36 restricts the cap body 58 not to be easily detached.

Each of the passage holes 51 includes an upper half large diameter portion 61*a* and a lower half small diameter passage 51*b*. A large diameter valve body 55 is formed integrally with a small diameter valve rod 56 located at the lower end thereof.

A packing 57 such as an O-ring for sealing is disposed on the lower surface of the valve body 55 so as to be fitted around the valve rod 56. The packing 57 and the valve body 55 are inserted into the large diameter portion 51*a* in a vertically movable manner, and the valve rod 56 is inserted into the small diameter passage 51*b*. The lower end of the valve rod 56 extends to the vicinity of the lower end opening of the small diameter passage 51*b*.

A spring device 58 such as a coil spring provided in the large diameter portion 51*a* always presses the valve body 155 in a downward direction.

In this state, when the packing 57 is pressed onto the bottom surface of the large diameter portion 51*a*, a valve-closed-state is established (see FIG. 11A).

In contrast, when a release rod 62 serving as a valve operation device in an after-mentioned air removal device 61 moves upward to press the valve rod 56 in an upward direction opposing to a biasing force of the spring device 58, the packing 57 departs from the bottom surface of the large diameter portion 51*a*, thereby establishing a valve-open-state, i.e. allowing communication with the atmosphere (see FIG. 11B).

The configuration of the maintenance unit 11 will next be described with reference to FIGS. 8 through 23. The maintenance unit 11 is provided with a recovery device 63 and an air removal device 61.

The recovery device 63 sucks ink from the nozzles, in a state in which the nozzle surface 29 of the recording head unit 10 mounted on the carriage 17 is covered with caps 64 (after-mentioned covering portions 643) while the carriage 17 pauses in a standby position (at the right end in FIG. 2 and FIG. 3 in the present embodiment). Then, clogging solidified ink, tiny dust particles, and air in the recording heads 34 are sucked out.

The air removal device 61 discharges air colleted in the air reservoir chambers 40 through the suction passages 47 as the air discharge passages and the opening/closing valve device 41, and also sucks and discharges leaking ink.

The recovery device 63 is disposed adjacent to the air removal device 61, which is disposed at the utmost end in the moving direction of the carriage 17.

Figure 12:
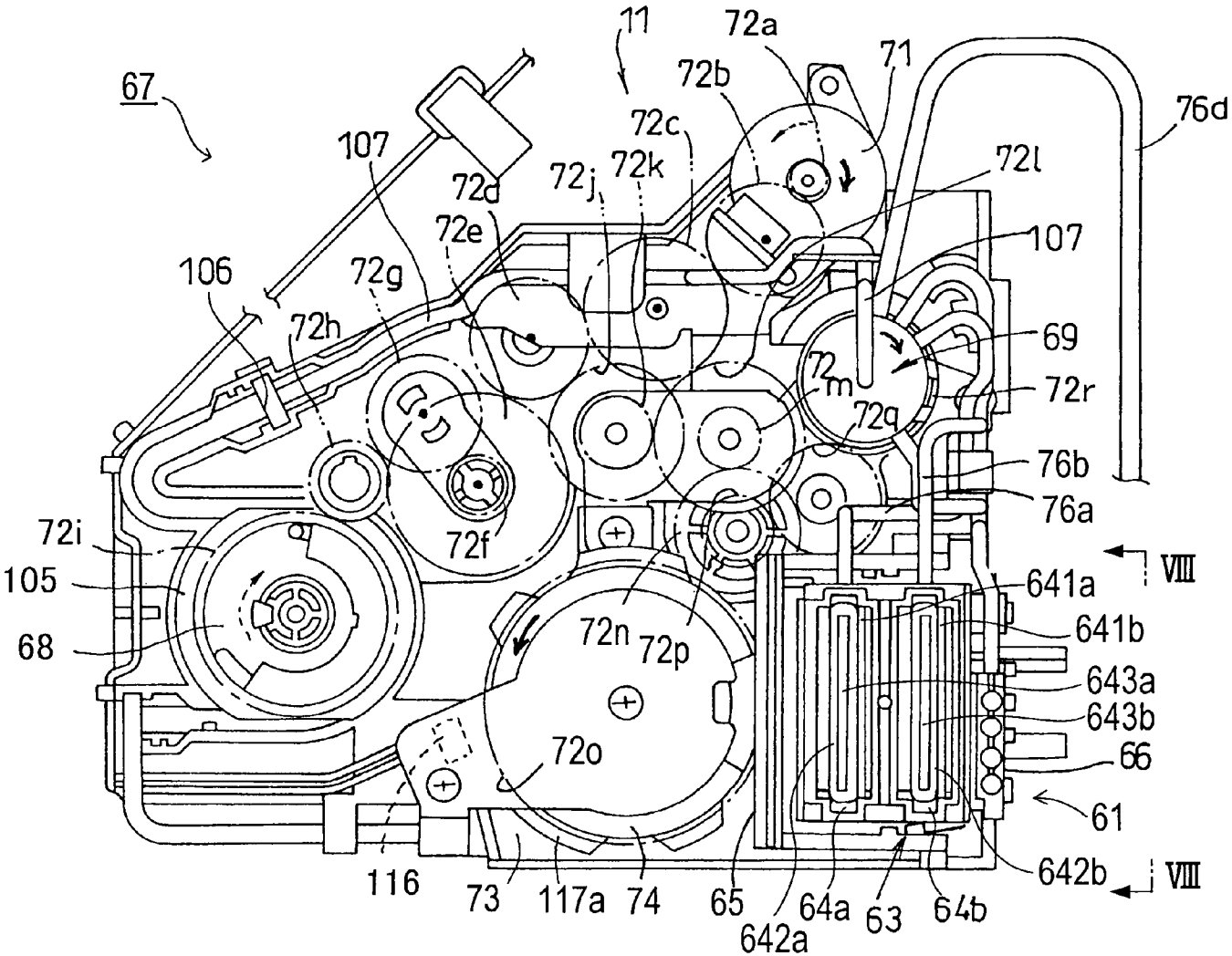
FIG. 12 is a plan view of the maintenance unit with a boundary line drawn between a sealing portion and a lip of each of caps for descriptive purposes only, although it is optional whether or not to really define a boundary therebetween.
Figure 13:
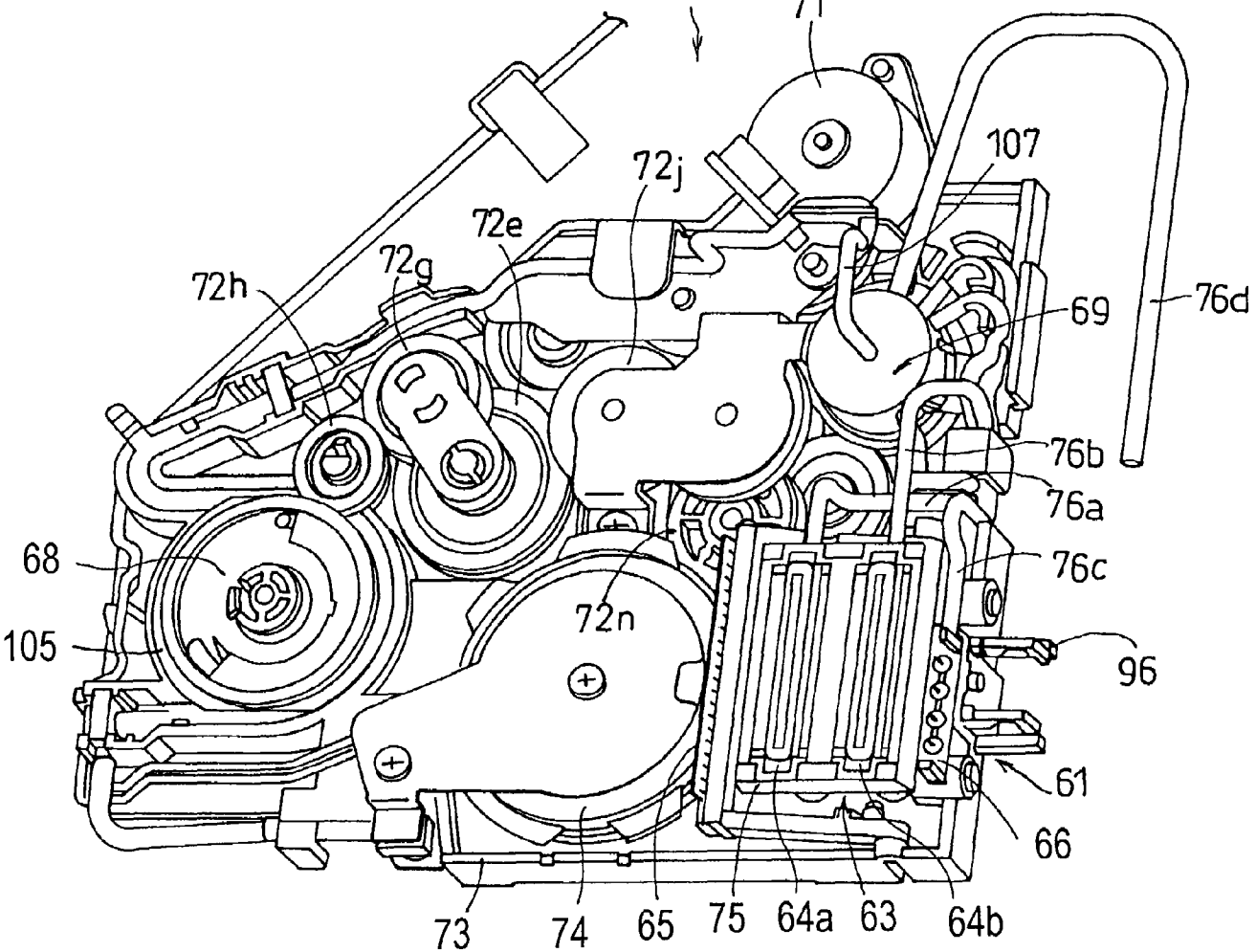
FIG. 13 is a perspective view of the maintenance unit with the boundary line drawn between the sealing portion and the lip of each of the caps for descriptive purposes only, although it is optional whether or not to really define a boundary therebetween.

A wiper 65 to wipe and clean the nozzle surface 29 is disposed, when seen in a plan view, opposite to an elevating body 66 provided with the release rods 62 in the air removal device 61 with respect to the caps 64 of the recovery device 63 located therebetween (see FIG. 12 and FIG. 13).

The maintenance unit 11 is provided with a mechanism portion 67 as an operation conversion device.

The mechanism portion 67 operates an elevating mechanism portion 70 that selectively moves upward/downward the recovery device 63 or the air removal device 61. The mechanism portion 67 also operates selectively a tube-type suction pump 68 as a suction device for sucking ink, and switches a switch valve unit 69 that selectively connects the sucking force of the suction pump 68 to the recovery device 63 or the air removal device 61.

The mechanism portion 67 is provided with a train of gears rotatably attached to a unit base 73, and a maintenance motor 71 rotatable in normal and reverse directions disposed at one end portion of the unit base 73 transmits power to the train of gears.

When the maintenance motor 71 rotates in a reverse direction (in a counterclockwise direction in FIG. 12), the driving force is used to rotate the suction pump 68 in a clockwise direction through a plurality of gears 72*a* through 72*i*, thereby providing a negative pressure to the switch valve unit 69 so as to suck ink as discussed hereinafter. In this case, among the gears 72*a* through 72*i*, a gear 72*e* and a sun gear 72*f* are rotated in a counterclockwise direction. This causes a planet gear 72*g* engaging with the sun gear 72*f* to rotate on its axis in a clockwise direction while revolving around the axis of the sun gear 72*f* in a counterclockwise direction. Then, the planet gear 72*g* engages with an intermediate gear 72*h*, thereby transmitting power to a gear 72*i* of the suction pump 68.

When the maintenance motor 71 rotates in a normal direction (in a clockwise direction in FIG. 12), the driving force is used to rotate the gear 72*e* and the sun gear 72*f* in a clockwise direction through gears 72*a* through 72*d*. This causes the planet gear 72*g* engaging with the sun gear 72*f* to rotate on its axis in a counterclockwise direction while revolving around the axis of the sun gear 72*f* in a clockwise direction. Then, the planet gear 72*g* engages with a subsequent gear 72*j*, and thereby rotates a rotating cam 74 in a counterclockwise direction through gears 72*k* through 72*o*, while transmitting power to a gear 72*r* so as to change the rotation angle of the switch valve unit 69 through gear 72*p* and 72*q*.

Next, the recovery device 63, the air removal device 61, the elevating mechanism portion 70 to selectively elevate these devices and the rotating cam 74 to drive the elevating mechanism portion 70 will be described with reference to FIG. 10 and FIGS. 12 through 20.

The recovery device 63 is provided with two caps 64*a*, 64*b* to cover the nozzle surface 29 exposed on the lower surface side of the carriage 17, and a supporting block 75 having a substantially rectangular shape, when seen in a plan view. The caps 64*a*, 64*b* are arranged in parallel with each other on the upper surface of the supporting block 75. The caps 64*a*, 64*b* are provided separately in order to avoid color mixture of ink.

The caps 64*a*, 64*b* are preferably made of butyl rubber having low air permeability. The caps 64*a*, 64*b* include respectively sealing portions 641*a*, 641*b* that seal the nozzles 33 by directly closing openings of the nozzles 33, and covering portions 643*a*, 643*b* having lips 642*a*, 642*b* (see FIGS. 21B and 21C), which maintain continuous close contact with the nozzle surface 29 around the openings of the nozzles 33, and forming sealed spaces on the surface formed with the openings of the nozzles 33 by the close contact of the lips 642*a*, 642*b*.

The sealing portions 641*a*, 641*b* have a linear shape extending along the rows of nozzles 38, and the lips 642*a*, 642*b* have a substantially rectangular frame-like shape enclosing therein the corresponding rows of nozzles. The width (a dimension in the horizontal direction in FIGS. 21B and 21C) of the utmost surface of each of the sealing portions 641*a*, 641*b* is about 1 mm to about 2 mm, while the width of the utmost surface of each of the lips 642*a*, 642*b* is about 0.3 mm to about 0.5 mm.

The covering portions 643*a*, 643*b* are provided with suction ports 644*a*, 644*b* of ink (see FIG. 21A), which communicate with tubes 76*a*, 76*b* through inside passages (not shown) of the supporting block 75 from two discharge ports in the lateral face of the supporting block 75. In this case, the cap 64*a* for black ink and cyan ink is connected to a port A of the switch valve unit 69 through the tube 76*a*. On the other hand, the cap 64*b* for magenta ink and yellow ink is connected to a port B of the switch valve unit 69 through the tube 76*b* (see FIGS. 22A, 22B, 23 and others).

Figure 15:
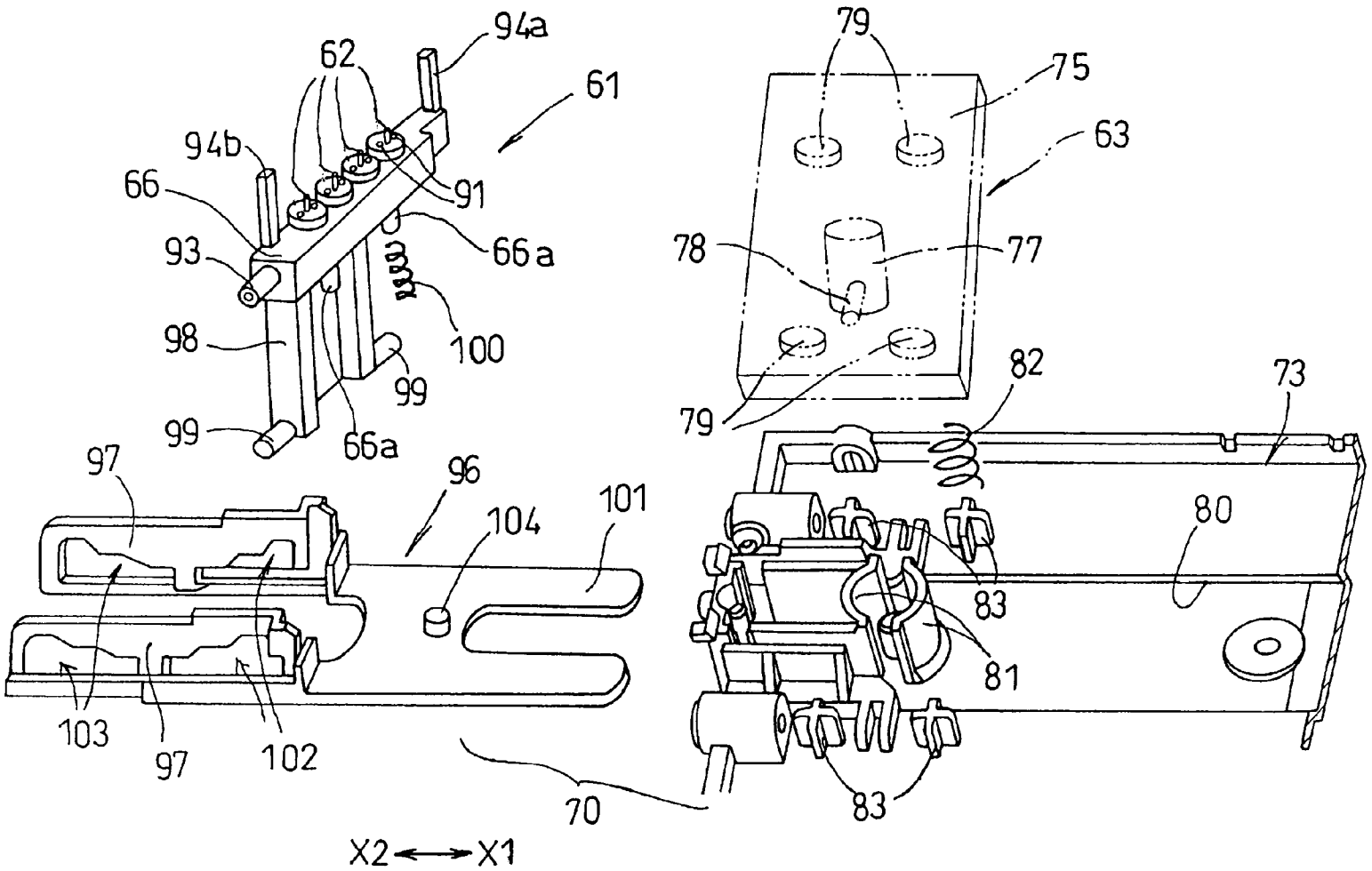
FIG. 15 is a perspective view showing a unit base, a parallel motion cam supporting block and an elevating body.
Figure 16B:
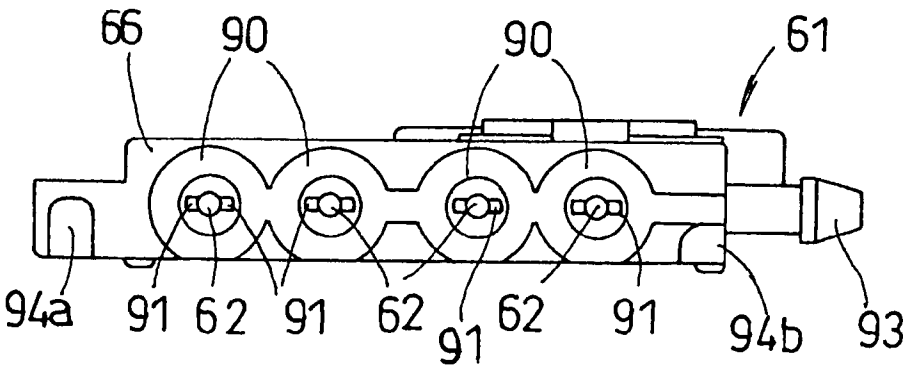
FIGS. 16A, 16B and 16C are a front elevational view, a plan view and a left-side elevational view, respectively, of the elevating body.
Figure 16A:
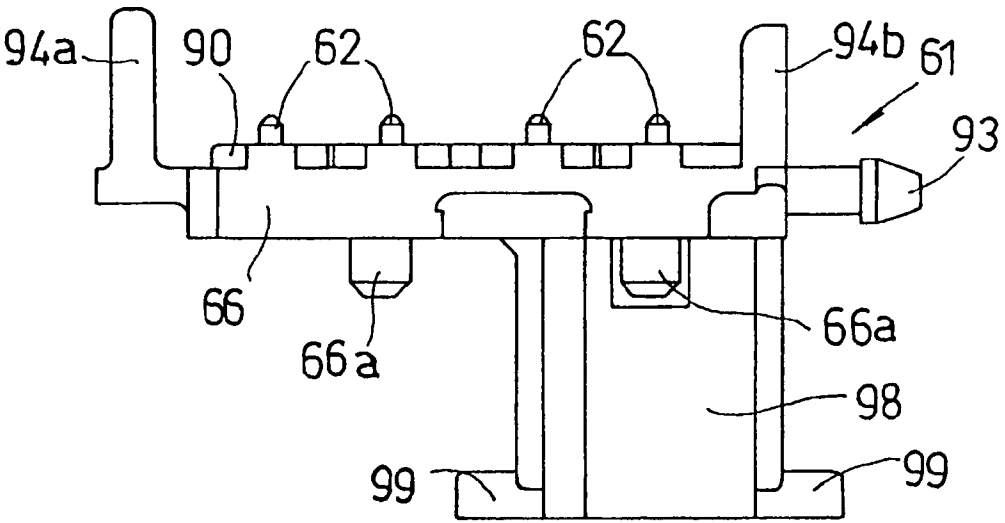
Figure 16C:
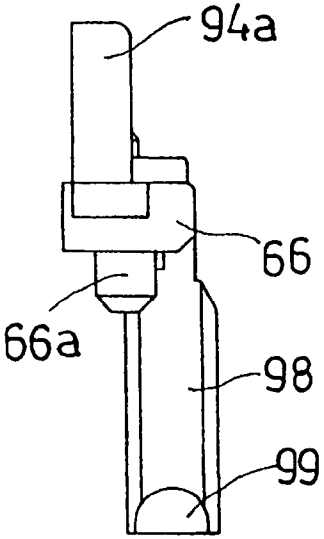
Figure 17A:
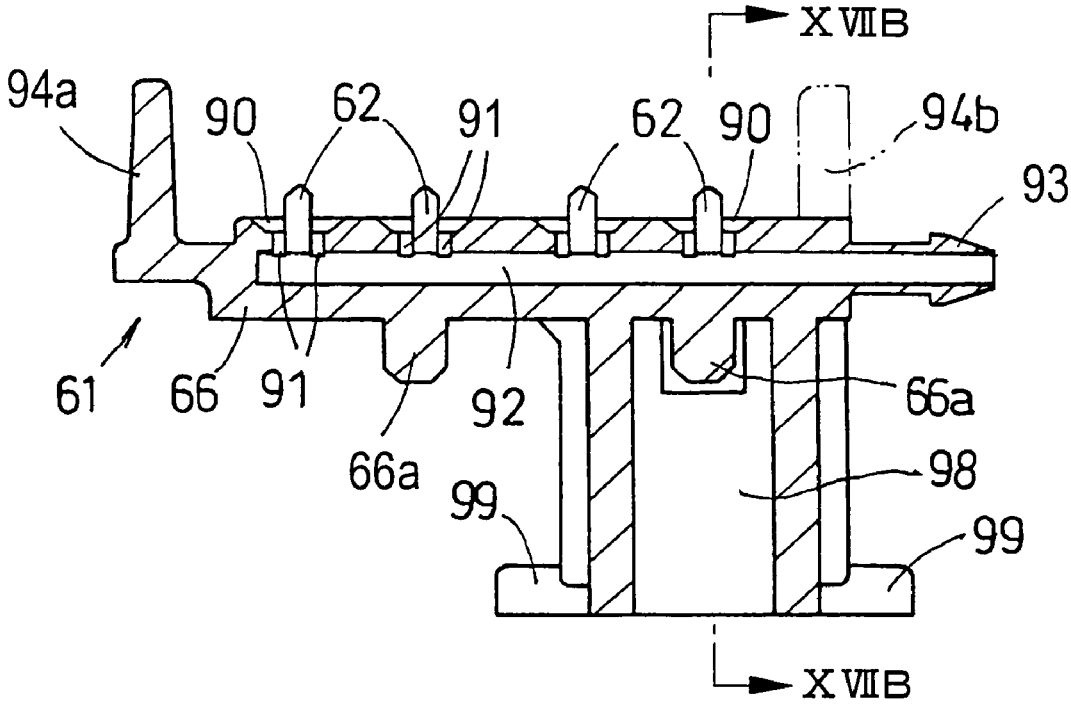
FIG. 17A is a cross-sectional view of the elevating body.
Figure 17B:
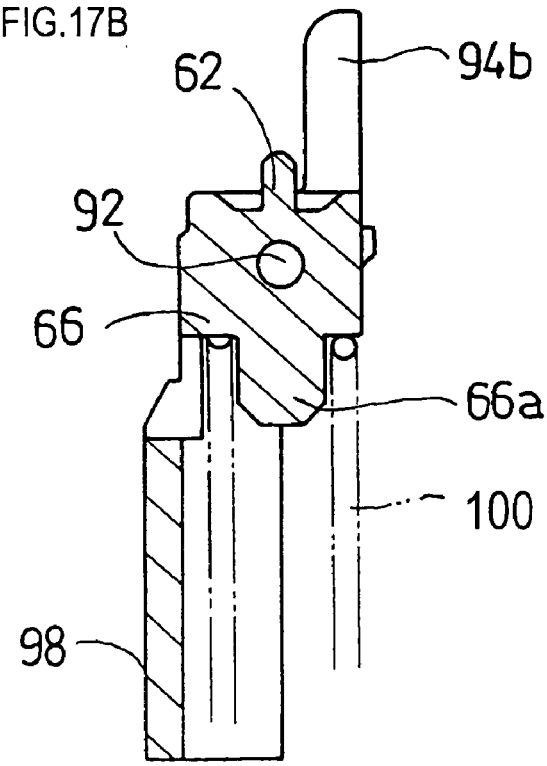
FIG. 17B is a cross-sectional view seen in the direction of arrows from line XVIIB-XVIIB of FIG. 17A.

As shown in FIG. 10 and FIG. 15, a guide cylinder 77 is provided in a center portion of the lower surface of the supporting block 75 made of synthetic resin or the like. A pair of sliding contact pins 78, 78 (only one of them is shown in the figures) as cam followers are provided so as to project in a horizontal direction from the outer side surface of the guide cylinder 77. Four spring seats 79 are provided on the lower surface of the supporting block 75 so as to project downward and surround the guide cylinder 77.

Figure 14:
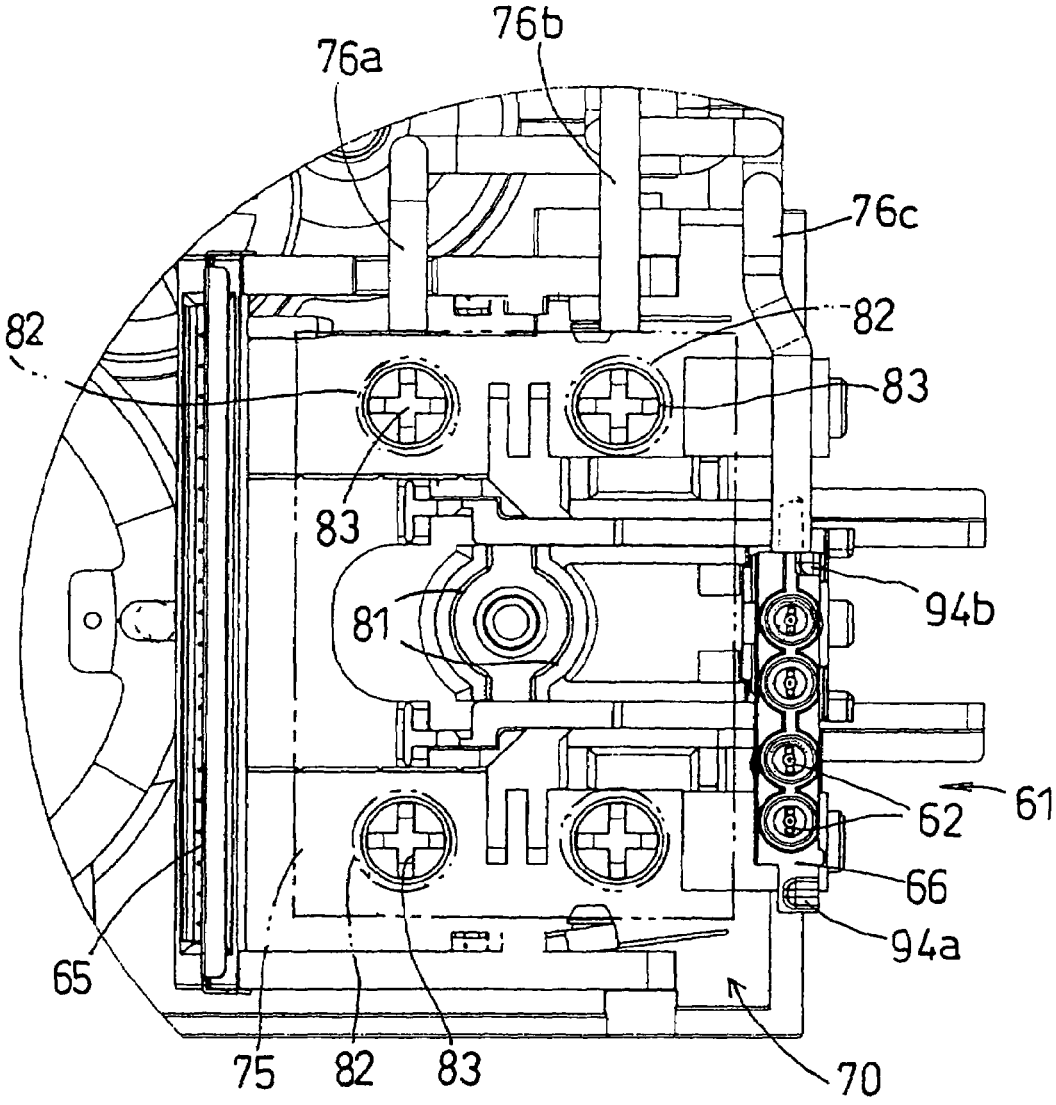
FIG. 14 is a partially enlarged plan view showing a portion in which the parallel motion cam is arranged.

On the other hand, a pair of guide pieces 81, 81 having a circular cross-section are provided to project from the approximate center of a guide channel 80 formed in an upper surface of the unit base 78 made of synthetic resin or the like (see FIG. 14 and FIG. 15). The guide pieces 81, 81 are designed to guide the guide cylinder 77 and the sliding contact pins 78, 78 in the upward and downward directions, and also to restrict the supporting block 75 not to rotate along a plane perpendicular to an elevating direction of the supporting block 75. Furthermore, projections 88 are provided to project from the outside of the guide channel 80 so as to position the lower ends of upward biasing springs 82 between the respective spring seats 79 and the projections 83.

As shown in FIGS. 14 through 17B, four circular plate-like sucking portions 90 capable of abutting the lower surface of the cylinder block 50 are formed on the upper surface of the elevating body 66 in the air removal device 61. The sucking portions 90 include the respective upward release rods 62 capable of being fitted in the respective small diameter passages 51*b* opened in the lower surface of the cylinder block 50, and suction openings 91 opened in the proximal end portions of the respective release rods 62. All of these suction openings 91 communicate with a discharge tube 93 on a lateral side of the elevating body 66 through a passage 92 in the elevating body 66 (see FIG. 17A).

In addition, a pair of substantially square rods 94*a*, 94*b* for positioning are provided to project upward from the upper surface of the elevating body 66 (see FIGS. 15 through 17B). When the elevating body 66 moves upward and approaches the cylinder block 50, the substantially square rods 94*a*, 94*b* slidingly contact a pair of positioning guide channels 95*a*, 95*b* provided in the cylinder block 50, and thereby the elevating body 66 can be properly positioned horizontally at two points. Thus, the release rods 62 can be smoothly fitted in the respective small diameter passages 51*b* (see FIG. 8).

The elevating body 66 is provided with legs 98 projecting downward and capable of being fitted between a pair of vertical guide pieces 97, 97 provided to an after-mentioned parallel motion cam 96. The legs 98 are provided with lower ends having a pair of sliding contact pins 99, 99 as cam followers projecting in a horizontal direction and outward along the longitudinal direction of the elevating body 66. Furthermore, two spring seats 66*a*, 66*a* are provided on the lower surface of the elevating body 66 so as to support the upper ends of upward biasing springs 100 (only one of them is shown in FIG. 15) provided between the lower surface of the elevating body 66 and the unit base 73 (see FIGS. 16 through 17B).

The operation conversion device selectively moves the caps 64*a*, 64*b* of the recovery device 63 to/from the nozzle surface 29 or moves the air removal device 61 upward/downward for valve opening/closing by the release rods 62. The operation conversion device includes the parallel motion cam 96 and the rotating cam 74.

As shown in FIGS. 10, 14, 15, 19 and 20, the parallel motion cam 96 includes a two-forked horizontal guide piece 101 to be guided horizontally along the guide channel 80 of the unit base 73 and the pair of vertical guide pieces 97, 97 erecting from the horizontal guide piece 101. A pin 104 projecting upward from the horizontal guide piece 101 is fitted in an endless cam groove 74*a* in the rotating cam 74 (see FIG. 18). As will hereinafter be described, in accordance with the rotation of the rotating cam 74 in a specific direction, the parallel motion cam 96 is reciprocated in a direction (X1-X2 direction in FIG. 10, 15, 19 and 20) perpendicular to the direction in which the elevating body 66 approaches and departs from the lower surface of the cylinder block 50.

Each of the vertical guide pieces 97, 97 is provided with cam portions having a pair of cam surfaces 102 and 103 that are abutted by the sliding contact pins 78 and 99 as cam followers respectively projecting horizontally from the recovery device 63 and the air removal device 61. The sliding contact pins 78 and 99 are biased by the biasing springs 82, 100 in the upward direction, and control upward/downward movement of the recovery device 63 and the air removal device 61 in accordance with tho reciprocation of the parallel motion cam 96.

The pair or cam surfaces 102 and 103 are formed such that the direction of upward/downward movement of the recovery device 63 and the direction of upward/downward movement of the air removal device 61 are opposite with each other. Specifically, the cam surfaces 102 and 103 respectively include horizontal lowermost cam surface 102*a*. 103*a*, horizontal intermediate cam surfaces 102*b*, 103*b* and horizontal uppermost cam surfaces 102*c*, 103*c* that are interconnected by inclined surfaces. The lowermost cam surface 102*a*, 103*a* are arranged to be close to each other, and the uppermost cam surfaces 102*c*, 103*c* are arranged to be remotest from each other (see FIG. 10 and FIG. 15).

Accordingly, as shown in FIG. 10, when the carriage 17 and thus the recording heads 34 are located over a maintenance section, abutment of the upper surface of the sliding contact pin 78 against the intermediate cam surface 102*b* results in retention of the supporting block 75 at a vertical position so as to provide an appropriate gap between the upper surfaces of the caps 64*a*, 64*b* and the nozzle surface 29 of the recording head 34.

At the same time, abutment of the upper surface of the sliding contact pin 99 against the intermediate cam surface 103*b* results in retention of the elevating body 66 at a vertical position so as to provide an appropriate narrow gap between the upper ends of the release rods 62 of the elevating body 66 and the lower surface of the cylinder block 50 in the air removal device 61.

Figure 20:
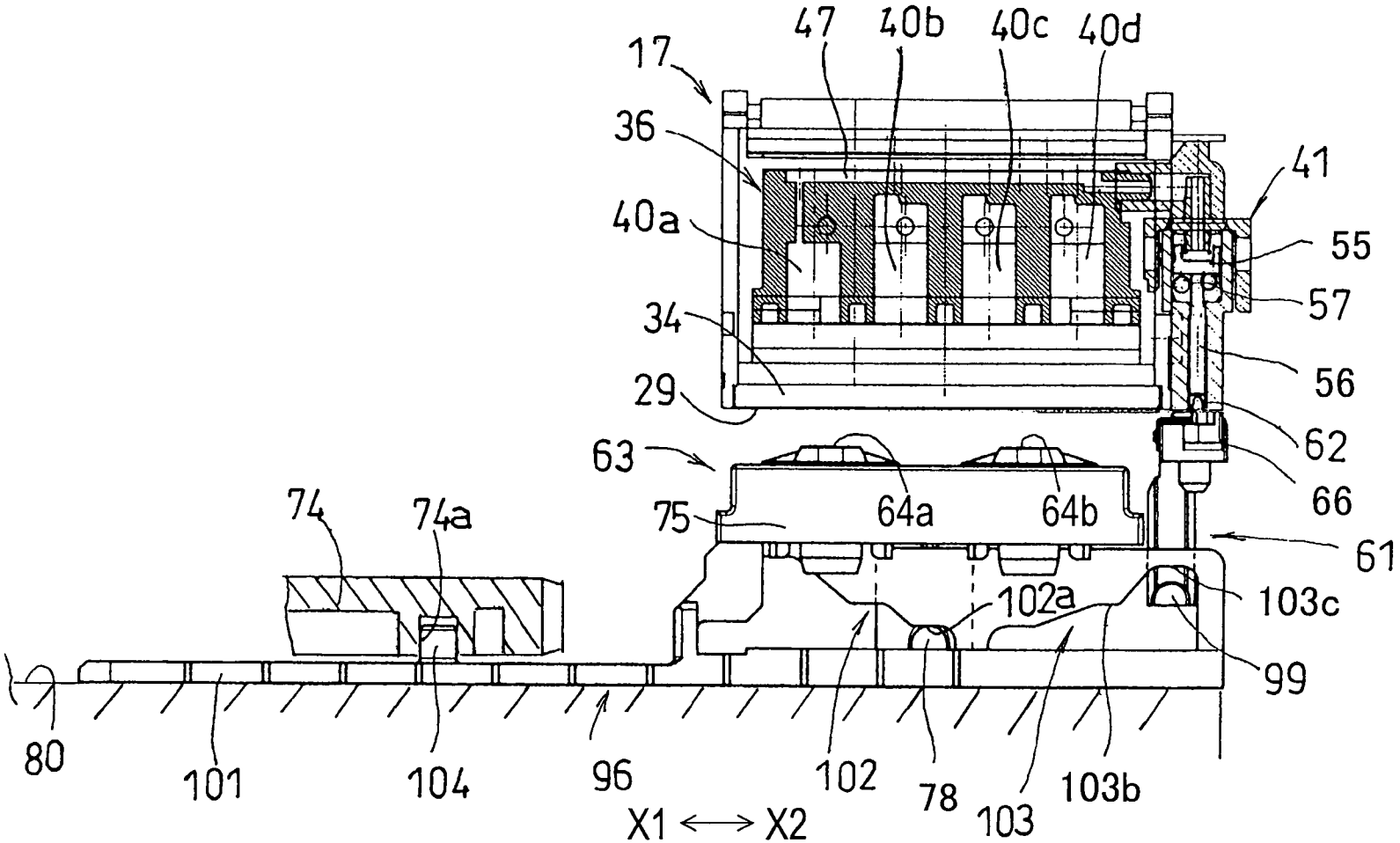
FIG. 20 is a side elevational view showing respective positions of the carriage, the parallel motion cam, the recovery device and the air removal device in a state of removing air from the buffer tank.

At the time of air removal operation from all of the air reservoir chambers 40*a* through 40*d* as shown in FIG. 20, the parallel motion cam 96 moves in X1 direction by the pin 104 fitted in the cam groove 74*a* of the rotating cam 74. This results in abutment of the upper surface of the eliding contact pin 78 against the lowermost cam surface 102*a*, and thus retention of the supporting block 75 at a lowermost position such that the upper surfaces of the caps 64*a*, 64*b* are remotest from the nozzle surface 29 of the recording head 34. At the same time, the sliding contact pin 99 moves from the intermediate cam surface 103*b* to the uppermost cam surface 103*c*, and restriction to an upward movement of the sliding contact pin 99 is lifted to cause the biasing spring 100 to move the elevating body 66 upward.

Then, each of the release rods 62 is fitted in the small diameter passage 51*b* opened in the lower surface of the cylinder block 50 so as to press up the valve rod 56 opposing to the biasing force of the spring device 58. Accordingly, tho valve body 65 and the packing 57 move upward into the valve opened state. Since a positive pressure is applied by the air pump 28 to the ink in the buffer tank 36, the air retained in the air reservoir chambers 40*a* through 40*d* is discharged to the atmosphere through the suction passage 47 and the passage hole 51 (see FIG. 11B).

Figure 19:
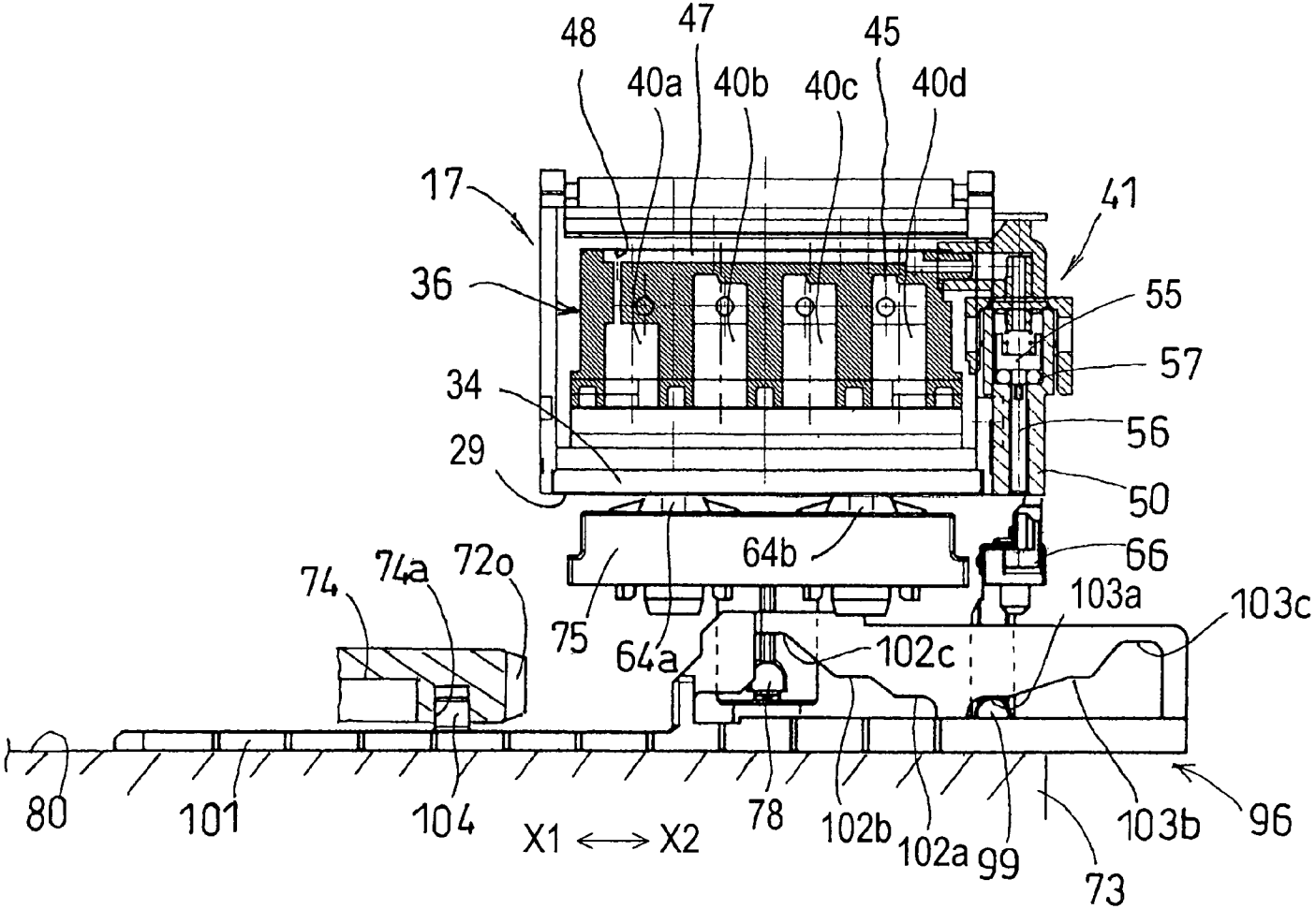
FIG. 19 is a side elevational view showing respective positions of the carriage, the parallel motion cam, the recovery device and the air removal device in a supported state.

On the other hand, as shown in FIG. 19, when the parallel motion cam 96 moves in X2 direction by the pin 104 fitted in the cam groove 74*a* of the rotating cam 74, the sliding contact pin 78 moves from the intermediate cam surface 102*b* to the uppermost cam surface 102*c*. Then, restriction to an upward movement of the sliding contact pin 78 is lifted to cause the biasing spring 82 to move the supporting block 75 upward. As a result, the upper surfaces of the caps 64*a*, 64*b* are pressed into a close contact with the nozzle surface 29 of the recording head 34.

At the same time, the upper surface of the sliding contact pin 99 abuts the lowermost cam surface 108*a,* and the elevating body 66 moves downward to the lowest position and are retained at a vertical position so as to provide an appropriate gap between the upper end of the release rod 62 in the elevating body 66 and the lower surface of the cylinder block 50 in the air removal device 61.

Figure 21A:
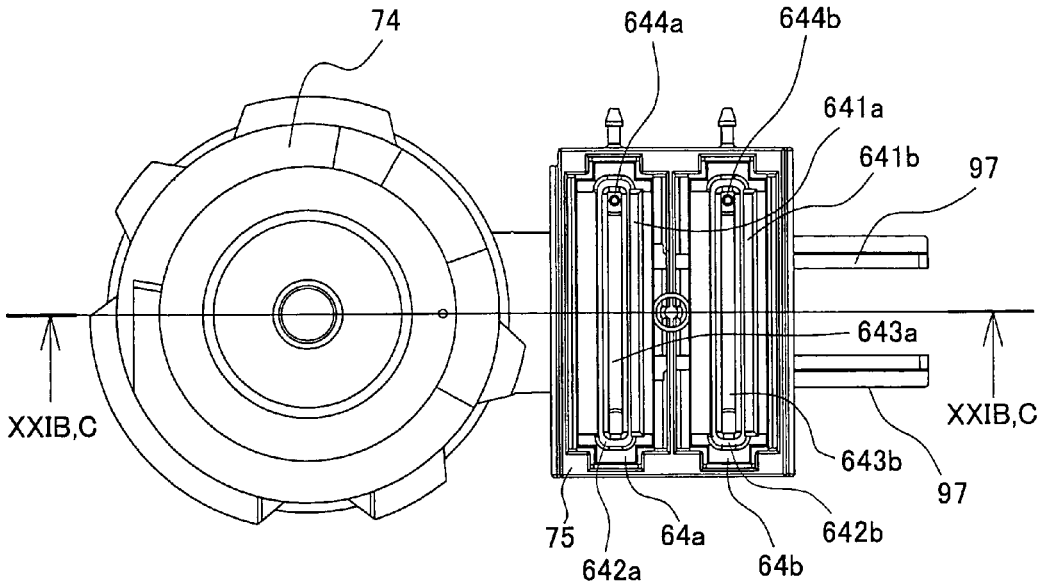
FIG. 21A is a plan view showing the configuration of the caps in detail with a boundary line drawn between the sealing portion and the lip of each of the caps for descriptive purposes only, although it is optional whether or not to really define a boundary therebetween.
Figure 21B:
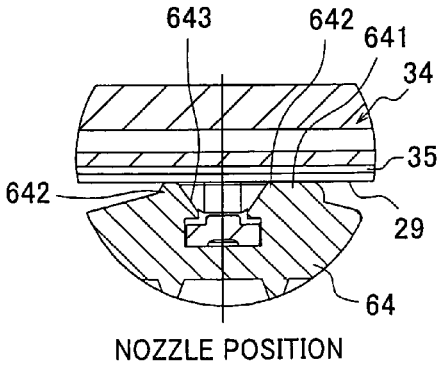
FIG. 21B is a cross-sectional view seen in the direction of arrows from line XXIB,C-XXIB,C of FIG. 21A in a short-time standby state, although showing here the configuration of the vicinity of only one of the two caps with the omission of subscripts "a" and "b"
Figure 21C:
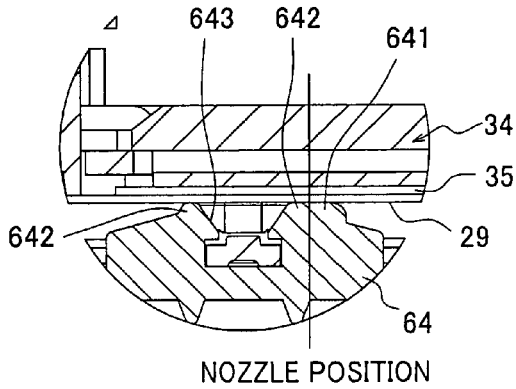
FIG. 21C is a cross-sectional view seen in the direction of arrows from line XXIB,C-XXIB,C of FIG. 21A in a long-time standby state, although showing here the configuration of the vicinity of only one of tho two caps with the omission of subscripts "a" and "b"

In this state, it may be possible to achieve the following two types of standby states depending on the configuration of the caps 64*a,* 64*b* in the present embodiment. FIG. 21A is a plan view showing the configuration of the caps 64*a,* 64*b* in detail, while FIGS. 21B and 21C are cross-sectional views along line XXIB,C-XXIB,C, showing the relationship between nozzle positions and the caps 64*a,* 64*b* in the two types of standby states. The nozzles 33 are arranged in substantially two rows, and the distance between the two rows of the nozzles 33, the distance between the sealing portions 641*a,* 641*b* and the distance between the covering portions 643*a,* 643*b* are all the same. Accordingly, the positional relationship between various parts of the cap 64*a* and the row of nozzles 38 located on the left side in FIG. 21A corresponds to the positional relationship between various parts of the cap 64*b* and the row of nozzles 33 located on the right side in FIG. 21A. It means that when the cap 64*a* is disposed at a position shown in FIG. 21B, the cap 64*b* is also disposed at the corresponding position. Therefore, subscripts "a" and "b" are omitted in FIGS. 21B and 21C.

As shown in FIG. 21B, when the cap 64 is pressed onto the nozzle surface 29 such that the nozzle position is located in tho center of the covering portion 643, the lip 642 continuously contacts the surrounding area of the openings of the nozzles 33, and a sealed space having a certain volume is formed on the surface formed with the openings of the nozzles 33. Accordingly, the ink in the nozzles 33 may dry when left for a long time in this state. However, there will not be any influence on discharge operation of the ink when left for a short time, since the cap 64 does not at all contact the surface formed with the openings of the nozzles 33. Such a standby state is hereinafter referred to as a "short-time standby state".

On the contrary, as shown in FIG. 21C, when the cap 64 is pressed onto the nozzle surface 29 such that the nozzle position is located in the center of the sealing portion 641, the sealing portion 641 having a substantially flat configuration seals the openings of the nozzles 33. In this case, although the direct sealing of the nozzles 33 has a high effect of preventing drying of ink; there may be an influence on discharge operation immediately after the cap 64 is detached, since the cap 64 directly seals the openings of the nozzles 33. Such a standby state is hereinafter referred to as a "long-time standby state".

A desired standby state may be selected from the above two standby states by adjusting the position of the carriage 17 when the supporting block 75 is moved upward as described above.

The suction device that is parallely connected to the air removal device 61 and the recovery device 63 and sucks ink will now be described. The suction device is provided with the suction pump 68 and the switch valve unit 69. The suction device selectively sucks ink leaking with air from the air reservoir chambers 40*a* through 40*d* or sucks ink from the nozzles 33 through the recovery device 63.

The suction pump 68 is a tube-type pump that generates negative pressure using a volume change in a flexible tube 105. One end of the flexible tube 105 (a discharge side) is connected to a discharged ink reservoir which houses waste liquid foam 111 therein (see FIG. 5), while the other end of the flexible tube 105 (a suction side) is connected to a discharge port 108 (see FIG. 22) of the switch valve unit 69 through a connector 106 and a tube 107 (see FIG. 12).

Figure 22A:
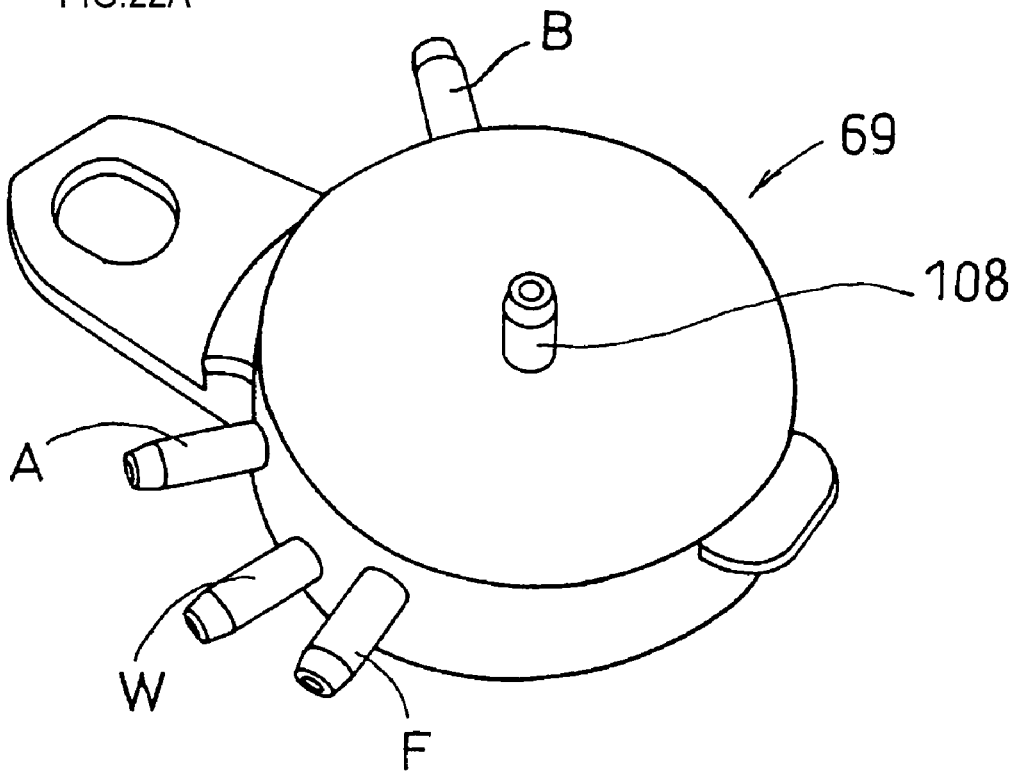
FIG. 22A is a perspective view of a switching valve unit.
Figure 22B:
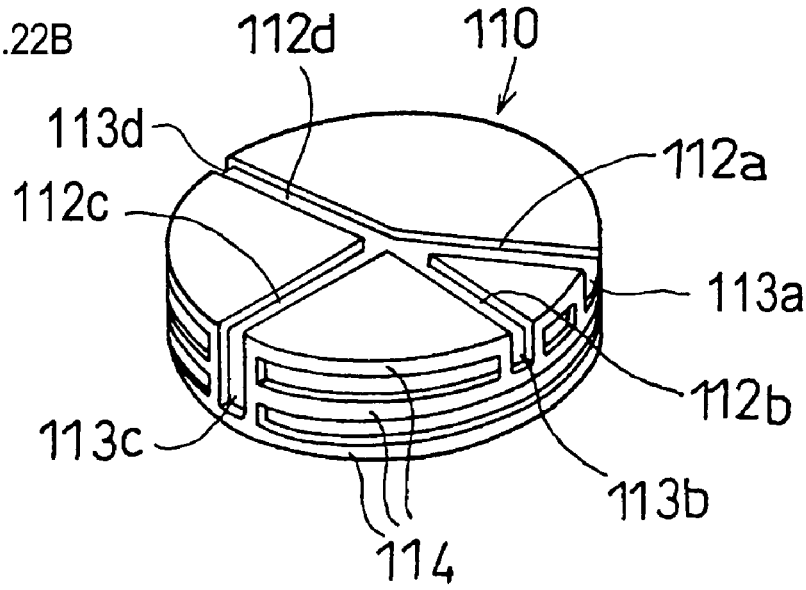
FIG. 22B is a perspective view of a switching member.
Figure 23:
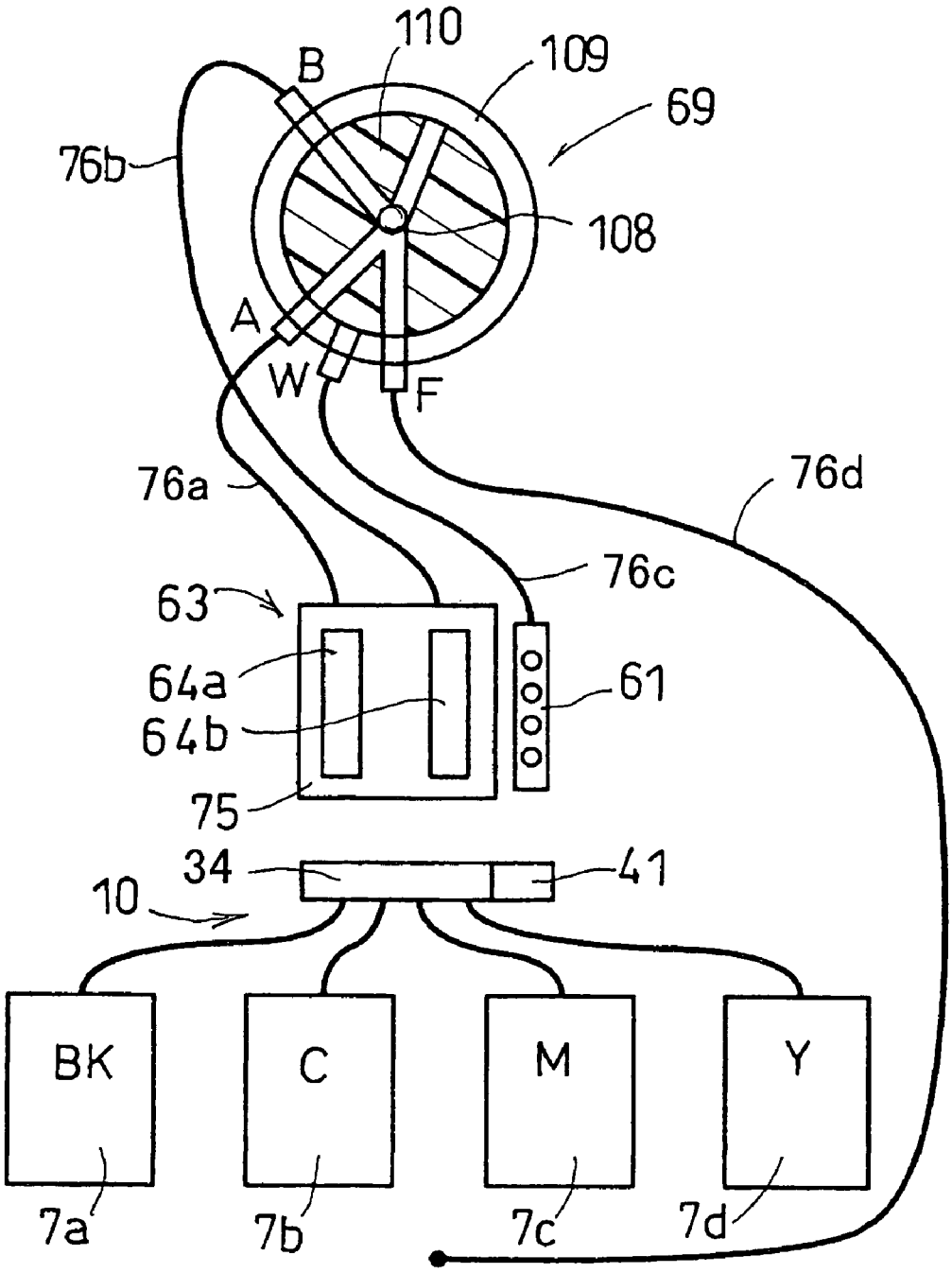
FIG. 23 is a diagram showing a connecting relationship among the switching valve unit, the recovery device and the air removal device with tubes.
Figure 29:
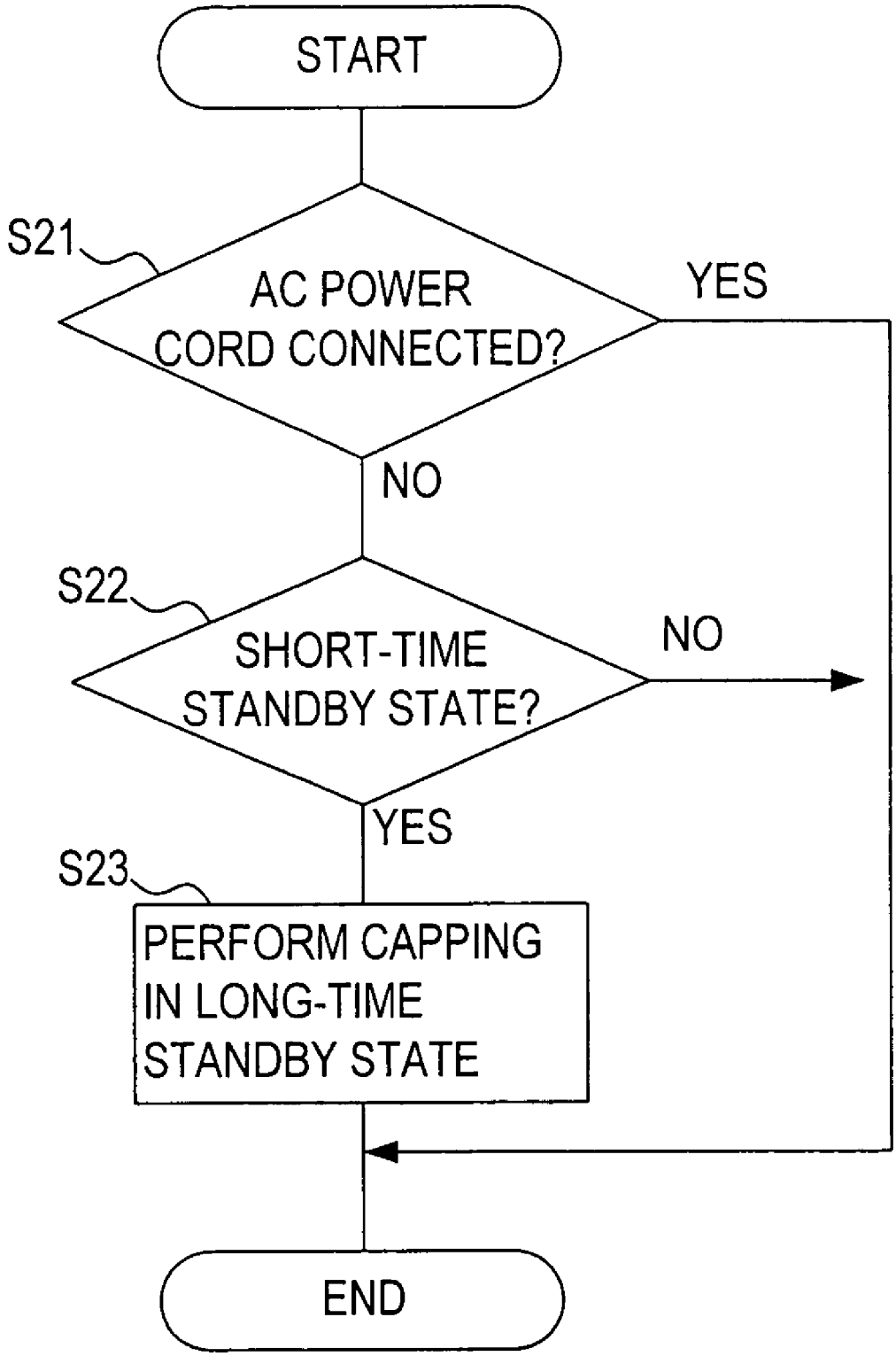
FIG. 29 is a flowchart showing interruption processing when an AC power cord is pulled out.

As shown in FIGS. 22A, 221 and 29, the switch valve unit 69 is provided with a cylindrical main body 109, a switching member 110 rotatably fitted in the main body. 109 and a gear 72*r* (see FIG. 12) rotating about a rotation shaft erected on the unit base 73 so as to rotate the switching member 110 with respect to the main body 109.

The main body 109 of synthetic resin is provided with the discharge port 108 on its upper surface, and ports A, B, W and F arranged at specified phase angles on the side surface of the main body 109. The port A is connected to the cap 64*a* through the tube 76*a,* the port B is connected to the cap 64*b* through the tube 76*b.* The port W is connected to the discharge tube 93 in the air removal device 61 through a tube 76*c,* while the port F is connected to a discharged ink tube 76*d* to be opened to the atmosphere.

Figure 4:
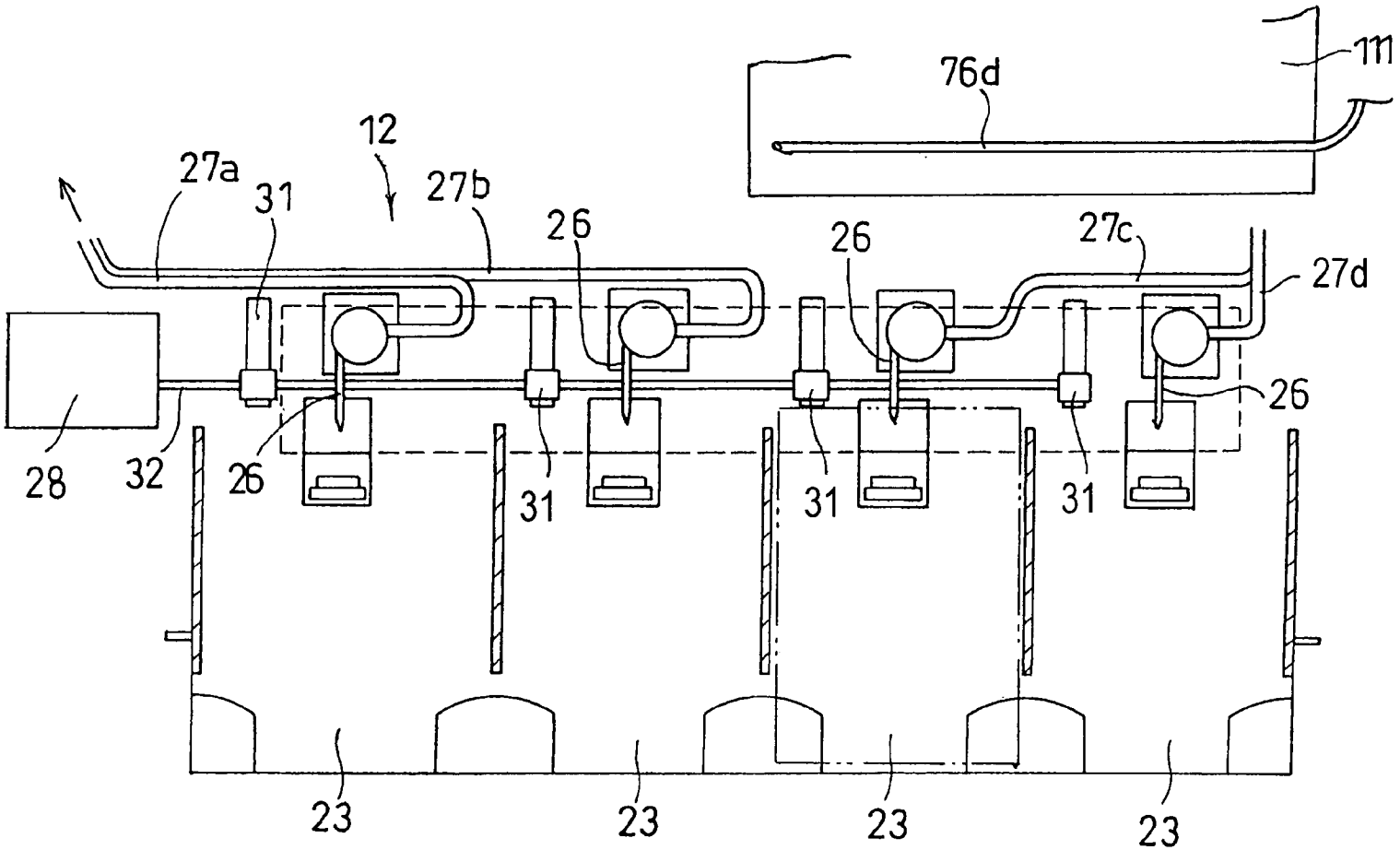
FIG. 4 is a schematic plan view of a cartridge attachment portion and an ink supply portion of the inkjet printer.

As shown in FIG. 12 and FIG. 13, the discharged ink tube 76*d*has a middle portion bent by 180 degrees or more when seen in a plan view and, as shown in FIG. 4 and FIG. 5, has an open end (an end opening) put downward into the thick waste liquid foam 111 in the main housing 2. The waste liquid foam 111 is disposed on a bottom plate 2*c* of the main housing 2 so as to have a length in the arranging direction of the ink cartridges 7*a* through 7*d* arranged in a right-and-left direction of the main housing 2 of the ink supply portion 12. The open end of the discharged ink tube 76*d*is located in a substantially longitudinal center portion of the main housing 2, that is, a portion in which the water head difference is the smallest when the main housing 2 is tilted in any of the right and left directions.

The cylindrical switching member 110, formed of an elastic material such as rubber, includes a circular top surface having top surface grooves 112*a* through 112*d* extending in four radial directions. The respective four ends of the top surface grooves 112*a* through 112*d* lead to outer circumferential grooves 118*a* through 118*d* of the switching member 110. The outer circumferential groove 113*c* extends a long distance downward so as to correspond to the port W. The outer circumferential grooves 113*a,* 113*b* and 113*d* extend a short distance downward so as to correspond to the ports A, B and F, respectively. The outer circumferential groove 113*c* also corresponds to the ports A, B and F.

Three ribs 114 are formed on the outer circumferential surface of the switching member 110 along the circumferential direction so as to surround the outer circumferential grooves 113*a* through 113*d.* By providing these ribs 114, it is possible to prevent leak of a negative pressure due to deformation, that is, formation of a gap between the switching member 110 and the main body 109, when the switching member 110 is rotated to retain or apply the negative pressure.

Figure 18:
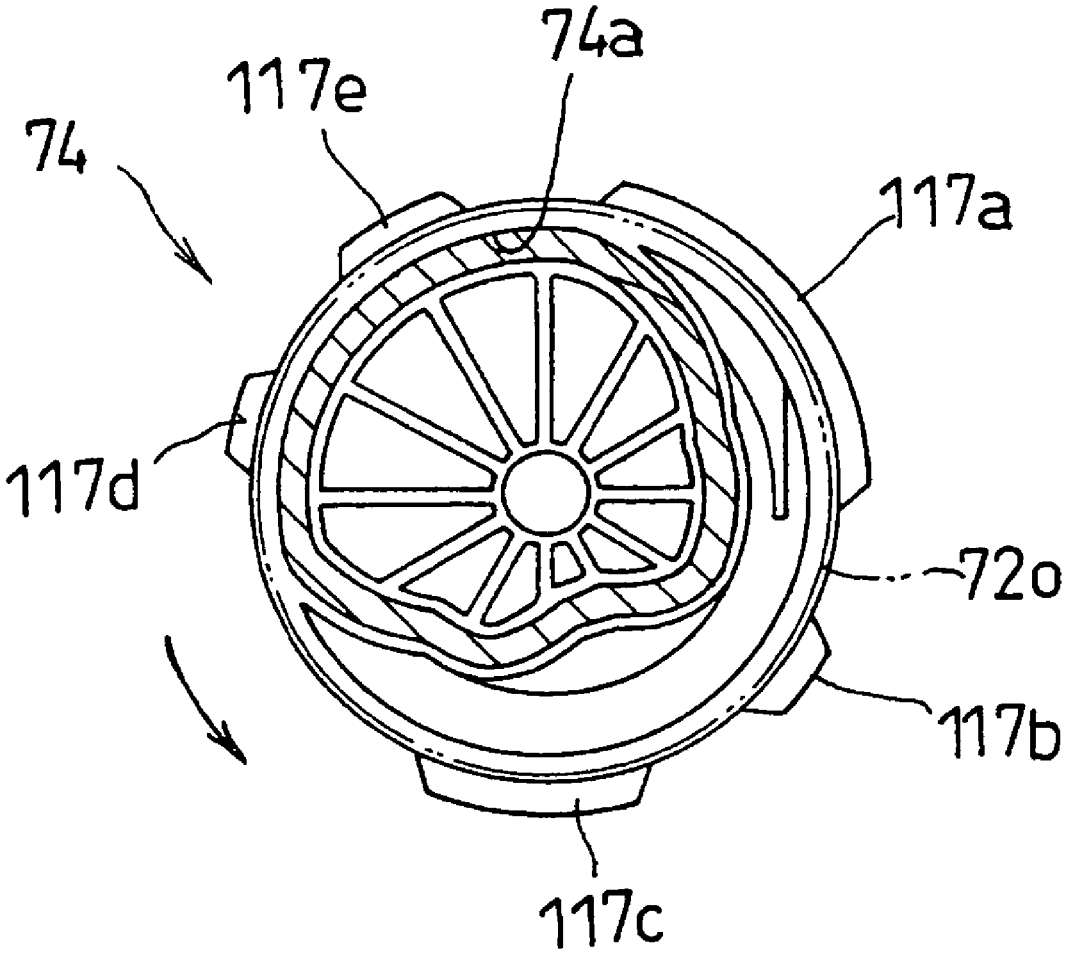
FIG. 18 is a view showing the configurations of a cam groove and a projecting cam seen from an upper side of a rotating cam.

As shown in FIGS. 10, 19 and 20, the bottom surface of the rotating cam 74 is provided with the endloss cam groove 74*a* in which the pin 104 of the parallel motion cam 96 is fitted, as described above. FIG. 18 is a view of the rotating cam 74 seen from above. The outer circumference of the rotating cam 74 is provided with a cam (not shown) to move the wiper 65 upward and downward and projecting cams 117*a* through 117*e* to contact a leaf switch 116 (FIG. 12) for detecting the rotational position (the phase) of the rotating cam 74.

The operation of the maintenance unit 11 will now be described. In FIG. 12, when the maintenance motor 71 is rotated in a reverse direction (in a counterclockwise direction), the suction pump 68 is rotated in a clockwise direction in FIG. 12, so that a negative pressure is applied to the discharge port 108 in the center portion of the top surface of the switch valve unit 69 to enable suction of ink. At this time, the switching member 110 of the switch valve unit 69 and the rotating cam 74 are not rotated and remain stationary. When the maintenance motor 71 is rotated in a normal direction (in a clockwise direction), the suction pump 68 is not rotated, and instead the switching member 110 of the switch valve unit 69 is rotated in a normal direction (in a clockwise direction) and the rotating cam 74 is rotated in a counterclockwise direction.

Figure 24:
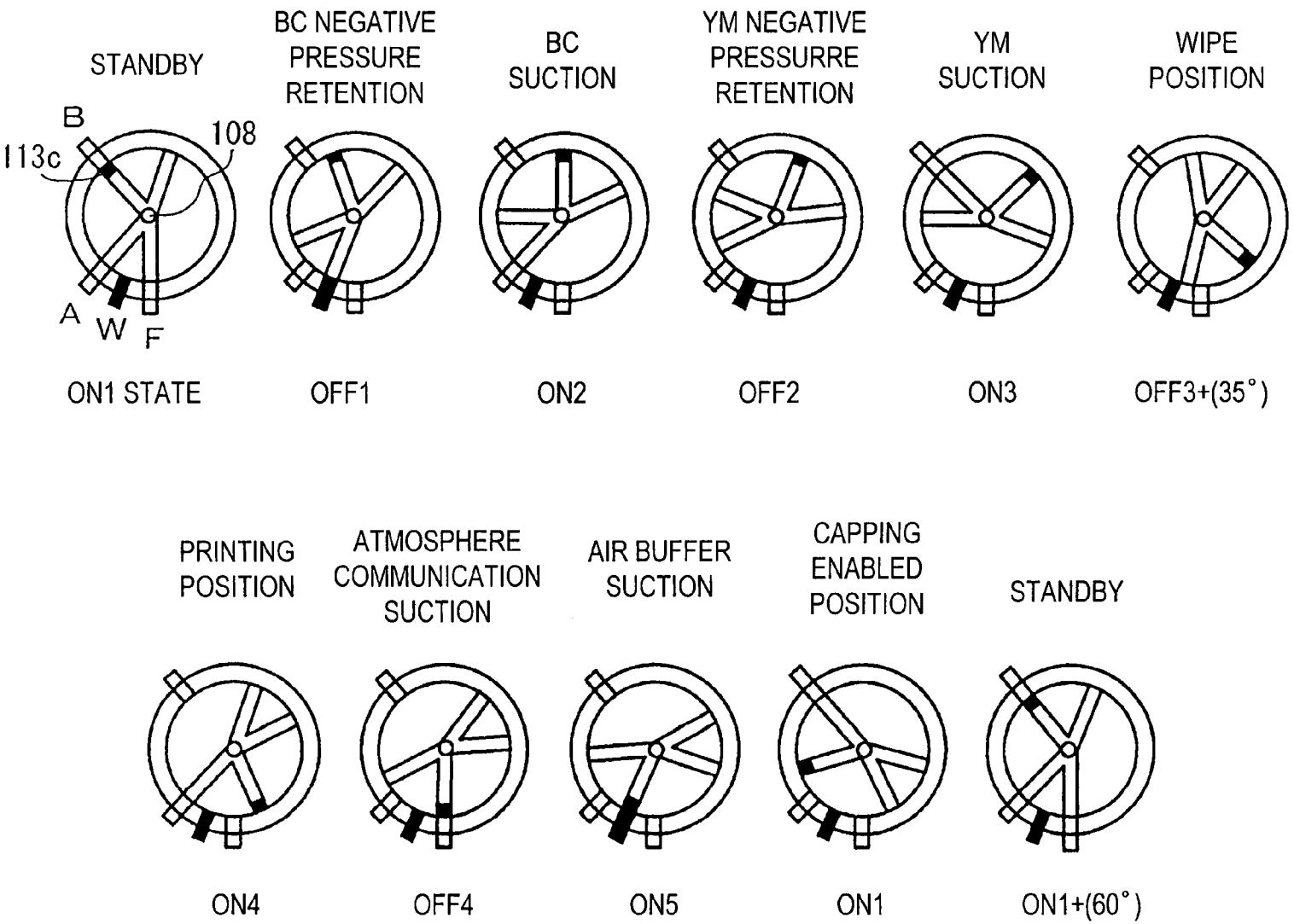
FIG. 24 is an explanatory view showing rotating phases of the switching member at respective operating positions in the switching valve unit.
Figure 25:
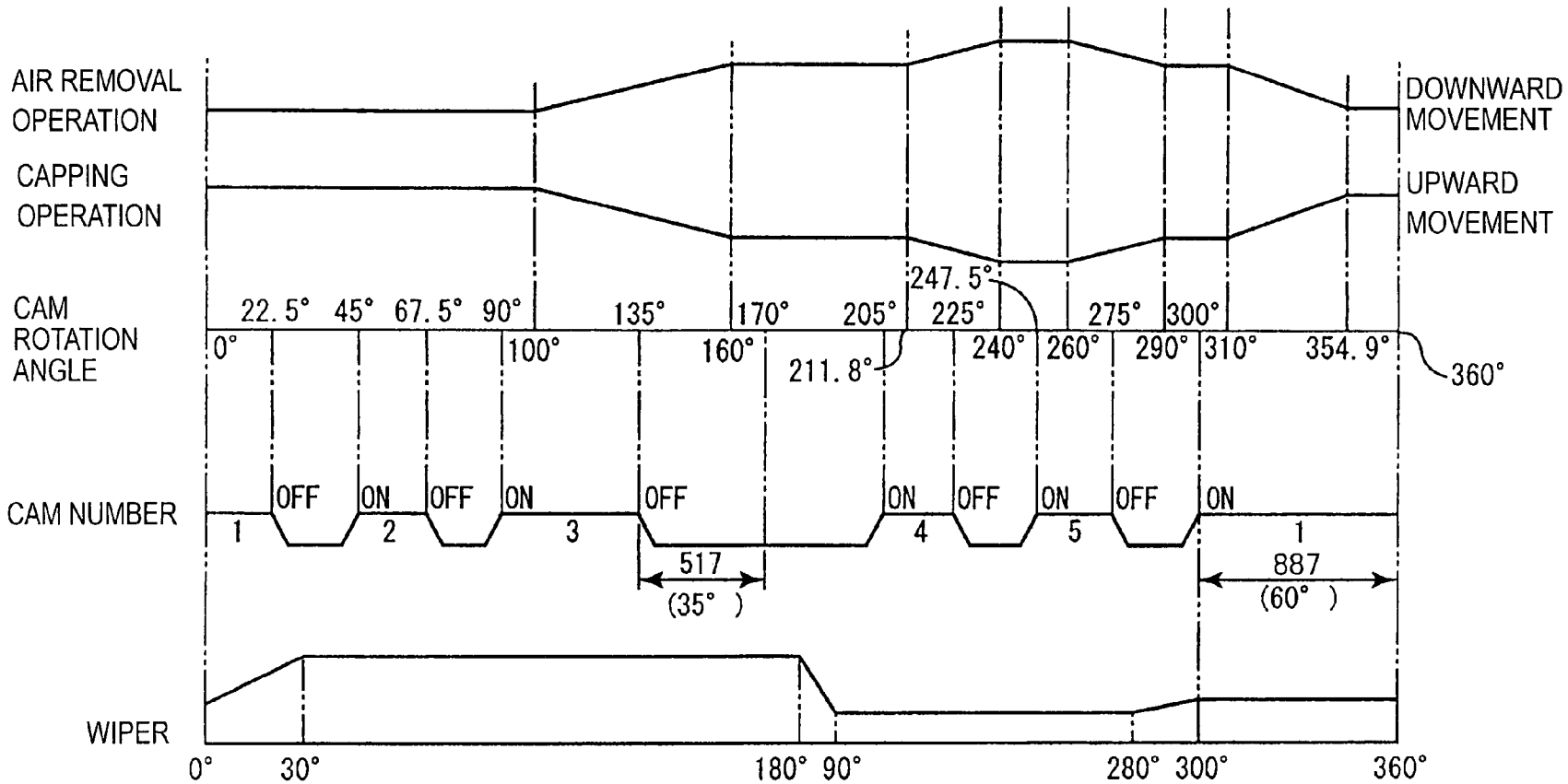
FIG. 25 is a timing chart of operations in accordance with the rotation angle of the rotating cam.

FIG. 24 shows rotational phase positions of the switching member 110 and communicated or non-communicated states with respect to the port A, B, W and F during respective operations. FIG. 25 shows a timing chart indicating air removal operation in accordance with the rotation of the rotating cam 74 (i.e. upward and downward movement of the elevating body 66), capping operation (upward and downward movement of the supporting block 75 for the caps 64*a*, 64*b*) and upward and downward movement of the wiper 65. To move the carriage 17 to the standby position at the right end in FIG. 2, the parallel motion cam 96 is moved to a position shown in FIG. 10 immediately after the leaf switch 116 leaves the projecting cam 117*e* (cam number 5) and rides the projecting cam 117*a* (cam number 1).

In this state, the upper surface of the sliding contact pin 78 abuts the intermediate cam surface 102*b*. and the supporting block 75 is retained at a vertical position so as to provide an appropriate gap between the upper surfaces of the caps 64*a*, 64*b* and the nozzle surface 29 of the recording heads 34. Also, the upper surface of the sliding contact pin 99 abuts the intermediate cam surface 103*b*, and the elevating body 66 is retained at a vertical position so as to provide an appropriate narrow gap between the upper ends of the release rods 62 of the elevating body 66 and the lower surface of the cylinder block 60 of the air removal device 61 (a capping enabled position). In this state, the rotational position of the switching member 110 of the switch valve unit 69 is at a phase of capping enabled position, and the ports A, B and F communicates with the discharge port 108.

At the time of shift to the standby state, the caps 84*a*, 84*b* are brought into close contact with the nozzle surface 29. For this purpose, the rotating cam 74 is rotated in a normal direction from a position (ON1), at which the leaf switch 116 is riding the projecting cam 117*a* (cam number 1) to a position at which the switching member 110 of the switch valve unit 69 is further rotated by 60 degrees. In this state, the parallel motion cam 96 is moved in the X2 direction to be set at a position shown in FIG. 19, and the sliding contact pin 78 moves from the intermediate cam surface 102*b* to the uppermost cam surface 102*c*. Then, the restriction to an upward movement of the sliding contact pin 78 is lifted to cause the biasing spring 82 to move the supporting block 75 upward.

As a result, the upper surfaces of the caps 64*a*, 64*b* are pressed into a close contact with the nozzle surface 29 of the recording heads 34. Then, the above described short-time standby state or long-time standby state may be achieved depending on the position of the carriage 17. On the other hand, the upper surface of the sliding contact pin 99 abuts the lowermost cam surface 103*a*, and the elevating body 66 moves downward to the lowest position (see FIG. 19).

In this state, the recording heads 34 communicate with the switch valve unit 69 through the ports A and B (see the standby position, ON1-state in FIG. 24), and some ink always remains in the switch valve unit 69. Therefore, drying of the nozzles 33 covered with the covering portions 643*a*, 648*b* may be prevented even when the short-time standby state is selected. Since the switch valve unit 69 communicates with the atmosphere through the port F, the insides of the covering portions 643*a* 643*b* also communicate with the atmosphere (i.e. under the atmospheric pressure state). The elevating body 66 of the air removal device 61, in turn, is at the lowest position. The position (the standby position) rotated by 60 degrees from the position (ON1) may be obtained by, for example, rotating the maintenance motor 71 including a stepping motor from the position (ON1) by a predetermined number of steps (887 steps).

When the short-time standby state is selected, the maintenance motor 71 is rotated in a normal direction in FIG. 12 to rotate the rotating cam 74 in a counterclockwise direction to a position (OFF1) at which the leaf switch 116 leaves the projecting cam 117*a* (cam number 1). When the maintenance motor 71 is then rotated in a reverse direction to actuate the suction pump 68, it is possible to temporarily retain a negative pressure in the tube 107 to suck black ink and cyan ink from the covering portion 643*a* (see BC negative pressure retention, OFF1 in FIG. 24). At this time, any of the ports A, B, W and F does not communicate with the atmosphere (i.e. the outside).

A little after the suction pump 68 is actuated, the air pump (a positive pressure pump) 28 is actuated to continuously operate for a predetermined time period so as to apply a positive pressure to the inside of the buffer tank 36. Then, the maintenance motor 71 is rotated in a normal direction to a position (ON2) at which the leaf switch 116 is riding the projecting cam 117*b* (cam number 2). Then, the port A communicates with the outer circumferential groove 113*a*, and ink may be sucked from the covering portion 643*a* (see BC suction, ON2 in FIG. 24).

At this position (ON2), the carriage 17 may not be located at the right end where capping is enabled, but may be located, for example, at the left end. Then, by actuating the auction pump 68, so-called idle suction can be performed thereby to remove ink remaining in the cap 64*a* detached from the recording head 34.

When a position (OFF2) is reached, at which the leaf switch 116 leaves the projecting cam 117*b* (cam number 2), it is possible to temporarily retain a negative pressure to suck magenta ink and yellow ink (see YM negative pressure retention, OFF2 in FIG. 24). Any of the ports A, B, W and F does not communicate with the atmosphere (i.e. the outside) at this time, either.

When a position (ON3) is then reached, at which the leaf switch 116 is riding the projecting cam 117*c* (cam number 3), the port B communicates with the outer circumferential groove 113*b*, and ink may be sucked from the cap 64*b* (sea YM suction, ON3 in FIG. 24).

In the same manner as in the case of the position (ON2), idle suction can be performed for the cap 64*b* at this position (ON3). In both of the above cases, the short-time standby state can be maintained with the openings of the nozzles 38 covered with the covering portions 643*a*, 643*b*, unless the suction pump 68 is actuated to proceed with the recovery processing. Also, when the carriage 17 is moved to a position for the long-time standby state, the openings of the nozzles 33 remain covered with the sealing portions 641*a*, 641*b* regardless of the actuation of the suction pump 68.

When the rotating cam 74 is further rotated in a counterclockwise direction so as to move the parallel motion cam 96 in the X1 direction to the position shown in FIG. 10, the supporting block 75 moves downward such that the caps

64*a*, 64*b* are detached from the nozzle surface 29. Then, when the carriage 17 is moved in the left direction in FIG. 2, the wiper 65 is moved upward 80 as to slidingly contact the nozzle surface 29 and thereby to wipe the ink adhered to the nozzle surface 29 at a wiping position prior to a printing position. The rotational phase of the switching member 110 of the switch valve unit 69 is a wipe position in FIG. 24, at which any of the outer circumferential grooves 113*a* through 113*d* is disconnected from any of the ports A, B, W and F.

To remove air from all of the air reservoir chambers 40*a* through 40*d* in the buffer tank 36 over the recording head 34, the rotating cam 74 is further rotated in the counterclockwise direction so as to move the parallel motion cam 96 in the X1 direction. Corresponding to the movement, the sliding contact pin 78 moves from the intermediate cam surface 102*b* to the lowermost cam surface 102*a*, and the supporting block 75 moves downward to the lowest position. On the other hand, the sliding contact pin 99 departs from the intermediate cam surface 103*b* and moves to the utmost cam surface 103*c*. Then, the restriction to an upward movement of the sliding contact pin 99 is lifted to cause the biasing spring 100 to move the elevating body 66 upward.

As a result, all the release rods 62 on the elevating body 66 press up all the valve rode 56, the valve bodies 55 and the packings 57 in the opening/closing valve device 41 into the valve opened state. That is, all the air reservoir chambers 40*a* through 40*d* communicate with the atmosphere through the suction passages 47*a* through 47*d*, the outlets 54, the passage cylinders 52 and the passage holes 51 (see FIG. 20, FIG. 11B).

Then, a positive pressure from the air pump 28 acts on the ink in the buffer tank 36 through the ink cartridges 7*a* through 7*d*, the ink needles 26 and the ink supply tubes 27*a* through 27*d*. Accordingly, the ink surfaces in the air reservoir chambers 40*a* through 40*d* are pressed up, so that the air above the ink surfaces may be discharged to the atmosphere through the passage holes 51 (the small diameter passages 51*b*). In this case, the positive pressure is increased by increasing the number of revolutions of the drive motor 30.

During the discharge of air as above, a small amount of ink leaks along with the air. To suck the leaked ink, the plate-like sucking portions 90 on the upper surface of the elevating body 66 are arranged to abut the lower surface of the cylinder block 50. When the rotating cam 74 is rotated to a position (ON5) at which the leaf switch 116 is riding the projecting cam 117*e* (cam number 5) on the outer circumference of the rotating cam 74, the rotational phase of the switching member 110 is a position at which the port W communicates with the outer circumferential groove 113*c* (see air buffer suction, ON5 in FIG. 24).

In this state, the maintenance motor 71 is rotated in the reverse direction and the suction pump 68 is actuated plurality of times intermittently, while maintaining the increased positive pressure by the air pump 28. Then, the small amount of ink that has leaked along with the air is discharged from the plate-like sucking portions 90 to the waste liquid foam 111, through the suction openings 91 around the proximal end portions of the release rods 62, the passages 92, the discharge tube 93, the tube 76*c*, the switching member 110 and the tube 105 connected to the discharge port 108 of the switch valve unit 69.

Since the caps 64*a*, 64*b* are provided with the integrally formed sealing portions 641*a*, 641*b* and covering portions 643*a*, 643*b* in the present embodiment, the above described two types of standby states may be achieved with one type of caps 64*a*, 64*b*. Furthermore, it is possible to suck ink in the nozzles 33 through the suction pump 68 in the short-time standby state. In this case, the ink in the sealed spaces formed between the openings of the nozzles 33 and the covering portions 643 (643*a*, 643*b*) is discharged to the outside of the sealed spaces through the suction ports 644 (644*a*, 644*b*). According to the present embodiment, the ink collected over the covering portions 643 (643*a*, 648*b*) can be discharged as described above, which facilitates easy maintenance of the caps 64*a*, 64*b*.

Figure 26:
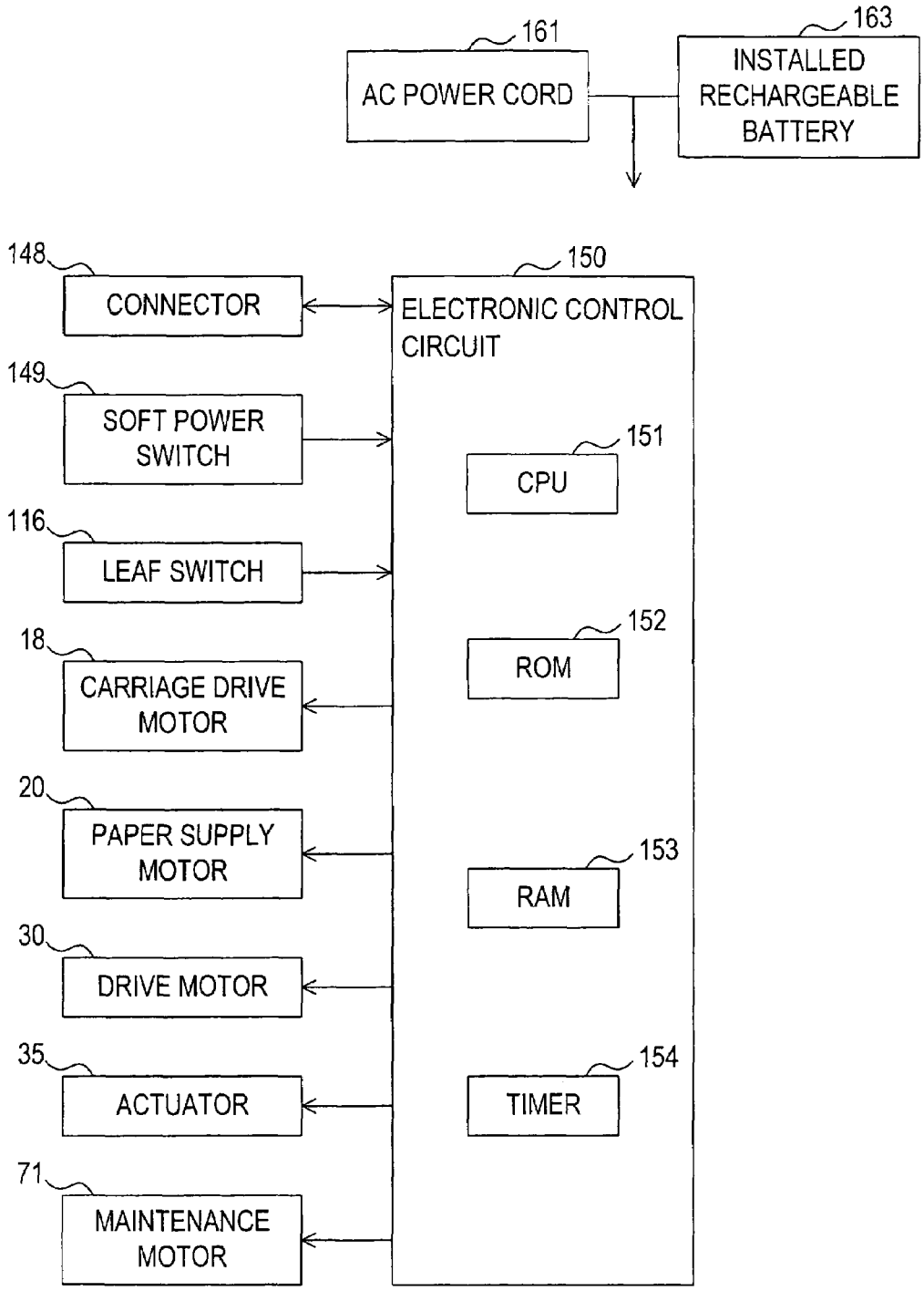
FIG. 26 is a block diagram showing the configuration of a control system of the inkjet printer.

Next, processing with regard to switching of the above standby states will be described with reference to FIGS. 26 through 29. FIG. 26 is a schematic block diagram showing the configuration of a control system which performs the processing. The multi-function apparatus 1 in the present embodiment is provided, besides the above described components, with a connector 148 performing input/output of recording data from/to a personal computer and the like and a soft power switch 149 that provides a state which appears to be substantially the same as a power-off state except that only some microcomputers such as an ROT operates. These components are connected to an electronic control circuit 150 along with the leaf switch 116, the carriage drive motor 18, the paper supply motor 20, the drive motor 30, the actuator 35 and the maintenance motor 71.

The electronic control circuit 160 is a known microcomputer basically configured with a CPU 151, a ROM 152 and a RAM 153, and is further provided with a timer 154 for measuring a time period for which the inkjet printer 5 is retained in a standby state. The multi-function apparatus 1 is also provided with an AC power cord 161 for supplying driving power for respective components from a commercial power source of AC 100V, and an installed rechargeable battery 163 to be recharged while the AC power cord 161 is connected. Accordingly, the respective components can be controlled for a while even after the AC power cord 161 is pulled out. A voltage transformation circuit, a rectifier and others, which are provided between the AC power cord 161 and the installed rechargeable battery 163, and the respective components such as the electronic control circuit 150 and the carriage drive motor 18, are well known and so will not be described in detail here.

Figure 27:
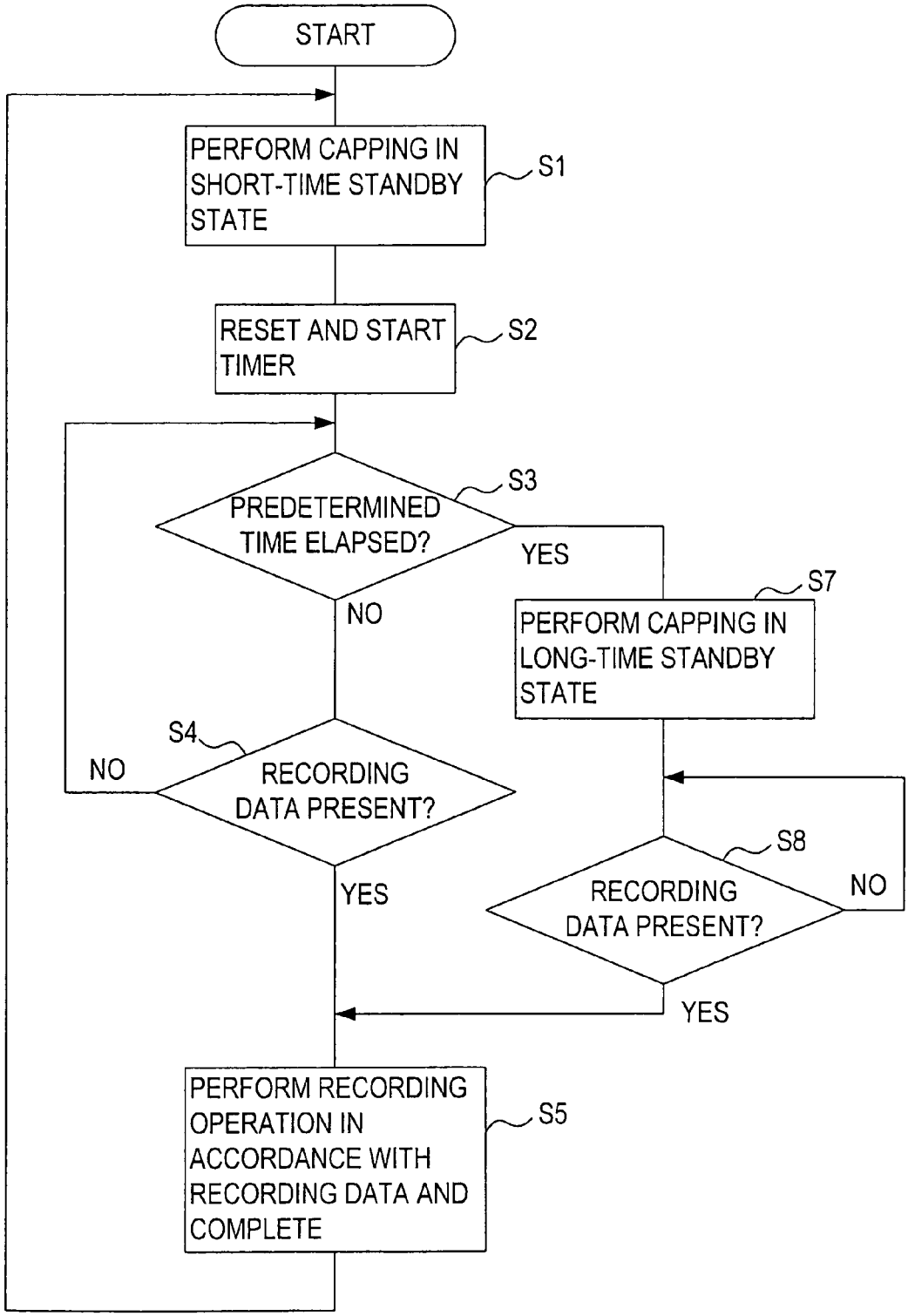
FIG. 27 is a flowchart showing a main routine of the processing in the control system.

FIG. 27 is a flowchart showing a main routine of the processing performed by the electronic control circuit 150. The electronic control circuit 150 performs the processing repeatedly at predetermined intervals while the power in on. When starting processing, the electronic control circuit 160 first performs a known initialization processing, and then performs capping in the short-time standby state in 81 (hereinafter S means a step). Specifically, the carriage drive motor 18 drives the maintenance motor 71 as described above so as to cover the nozzles 33 with the covering portions 643*a*, 643*b* as shown in FIG. 21B.

In S2, the timer 154 is reset and started, and the present process proceeds to S3.

In S3, it is determined whether a predetermined time as the standby time has elapsed based on the timer 154. If it is determined that the predetermined time has not elapsod (S3: No), the process proceeds to S4, in which it is determined whether there is any recording data received from the connector 148.

If it is determined that there is no recording data (S4: No), the process returns to S3, and then performs the processing in S3 and S4 repeatedly.

If it is determined that there is recording data received before the predetermined time has elapsed (S4: Yes), the process proceeds to S5. In S5, the carriage drive motor 18, the paper supply motor 20 and the actuator 35 are driven in accordance with the recording data to perform recording operation. After the completion of the recording operation, the process returns to S1.

On the other hand, if it is determined that the predetermined time has elapsed without receiving any recording data (S3: Yes), the process proceeds to S7, in which capping is performed in the long-time standby state. Specifically, the carriage drive motor 18 and the maintenance motor 71 are driven as described above so as to cover the nozzles 33 with the sealing portions 641*a*, 641*b* as shown in FIG. 21C.

In S8, it is determined whether there is any recording data. If it is determined that there is no recording data (S8: No), the process remains in the standby state. When it is determined that recording data has been received (S8: Yes), the process proceeds to S5 to perform recording operation. After the completion of the recording operation, the process returns to S1. By the above described processing, capping can be performed automatically in the long-time standby state when the standby time has exceeded a predetermined time (S3: Yes).

In the case of performing recording operation when the process proceeds to S5 from the short-time standby state, wiping operation is omitted and recording operation is performed immediately after a preliminary discharge over the ink receiving portion 8. In the case of performing recording operation when the process proceeds to S5 from the long-time standby state, recording operation is performed after wiping of the nozzle surface 29 with the wiper 65 and a preliminary discharge over the ink receiving portion 8.

Figure 28:
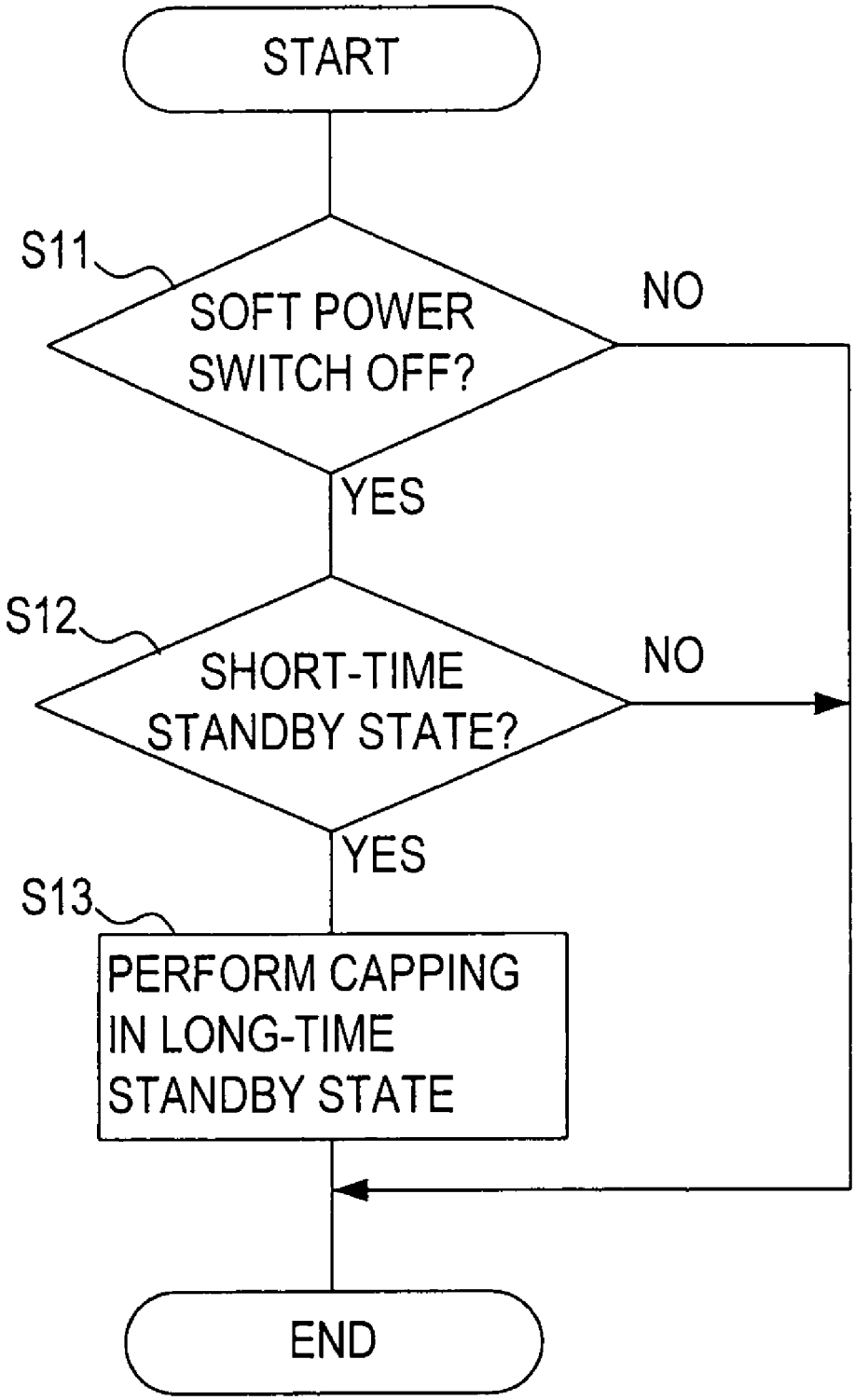
FIG. 28 is a flowchart showing interruption processing when a soft power switch is turned off.

FIG. 28 is a flowchart showing interruption processing periodically performed to monitor the state of the soft power switch 149. Specifically, it is determined in S11 whether or not the soft power switch 149 has been turned off. When it is determined that the soft power switch 149 has not been turned off (S11: No), the process is ended. When it is determined that the soft power switch 149 has been turned off (S11: Yes), the process proceeds to S12, in which it is determined whether or not the inkjet printer 5 is in the short-time standby state.

When it is determined that the inkjet printer 5 is not in the short-time standby state, i.e. in the long-time standby state (S12: No), the process is ended. When it is determined that it is in the short-time standby state (S12: Yes), the process proceeds to S13, in which capping is performed in the long-time standby state in the same manner as in S7, and the process is ended. By the above described processing, capping can be performed automatically in the long-time standby state when the soft power switch 149 is turned off (S11: Yes).

FIG. 29 is a flowchart showing interruption processing periodically performed to monitor the state of the AC power cord 161. Specifically, in S21, it is determined whether or not the AC power cord 161 is connected. When it is determined that the AC power cord 161 is connected (S21: Yes), the process is ended. When it is determined that the AC power cord 161 is not connected (S21: No), the process proceeds to S22, in which it is determined whether or not the inkjet printer 5 is in the short-time standby state.

When it is determined that the inkjet printer 6 is not in the short-time standby state, i.e. in the long-time standby state (S22: No), the process is ended. When it is determined that it is in the short-time standby state (S22: Yes), the process proceeds to 828, in which capping is performed in the long-time standby state in the same manner as in S7, and the process is ended. In this case, the operation of the maintenance motor 71 and the like is performed using electrical power charged by the installed rechargeable battery 163. By the above described processing, capping can be performed automatically in the long-time standby state when the AC power cord 161 is pulled out of an electrical outlet (S21: No).

According to the above processing, when recording operation is not performed for a long time, capping is automatically performed in the long-time standby state to prevent drying of ink and thereby to maintain a good discharge performance of the nozzles 33. On the other hand, when time in which recording operation is not performed is not longer than the predetermined time (S3: No), capping is performed in the short-time standby state without directly sealing the openings of the nozzles 33, facilitating an immediate shift to the subsequent recording operation.

In the present embodiment, the rows of nozzles 33, the sealing portions 641*a*, 641*b*, and the covering portions 643*a*, 643*b* are arranged in parallel with one another, in a direction perpendicular to the moving direction of the carriage 17. Also, the distance between the two rows of nozzles 33, the distance between the sealing portions 641*a*, 641*b*, and the distance between the covering portions 648*a*, 643*b* are all the same. Accordingly, it is possible to provide the short-time standby state and the long-time standby state to all rows of nozzles (four rows of nozzles) 33 at the same time, and to minimize the moving amount of the carriage 17 at the time of switching between the two states. Therefore, it is possible to further downsize the inkjet printer 6 as well as to reduce the load on the carriage drive motor 18.

In the present embodiment, recording operation may be designed to be performed after the below-described recovery operation when the inkjet printer 5 has not been used for a long time (e.g. two weeks or more). Specifically, while maintaining the long-time standby state, the air pump 28 is driven by the drive motor 30 so as to apply a positive pressure to the ink in the ink reservoir chambers 24*b*. Then, by moving the carriage 17, the nozzles 33 are shifted to face the covering portions 643*a*, 643*b*.

As a result, the surfaces of the openings of the nozzles 33 are suddenly exposed to the air pressure, and the ink in the nozzles 33 is quickly discharged along with the air. In this case, since the ink can be discharged with high pressure applied from the beginning, wasteful ink discharge before sufficient pressure is achieved may be avoided. Furthermore, since the discharged ink is collected in sealed spaces formed between the openings of the nozzles 33 and the covering portions 643*a*, 643*b*, the surrounding area will not be spoiled. The ink collected over the covering portions 643*a*, 643*b* can be removed by the above described idle suction.

In the present embodiment, in which the sealing portions 641*a*, 641*b*, and the covering portions 643*a*, 643*b* are formed integrally to be adjacent to each other, not only the nozzles 33 can be sealed by the above described two types of methods without leading to an increased manufacturing cost or an increased size of the inkjet printer 5, but also recovery operation as described above may be performed.

It is to be understood that the present invention is not limited to the above described embodiment, but may be practiced in various forms within the scope not departing from the gist of the present invention. The present invention may be applied, for example, to various types of inkjet printers as well as to droplet discharge apparatus of different types.

Figure 30:
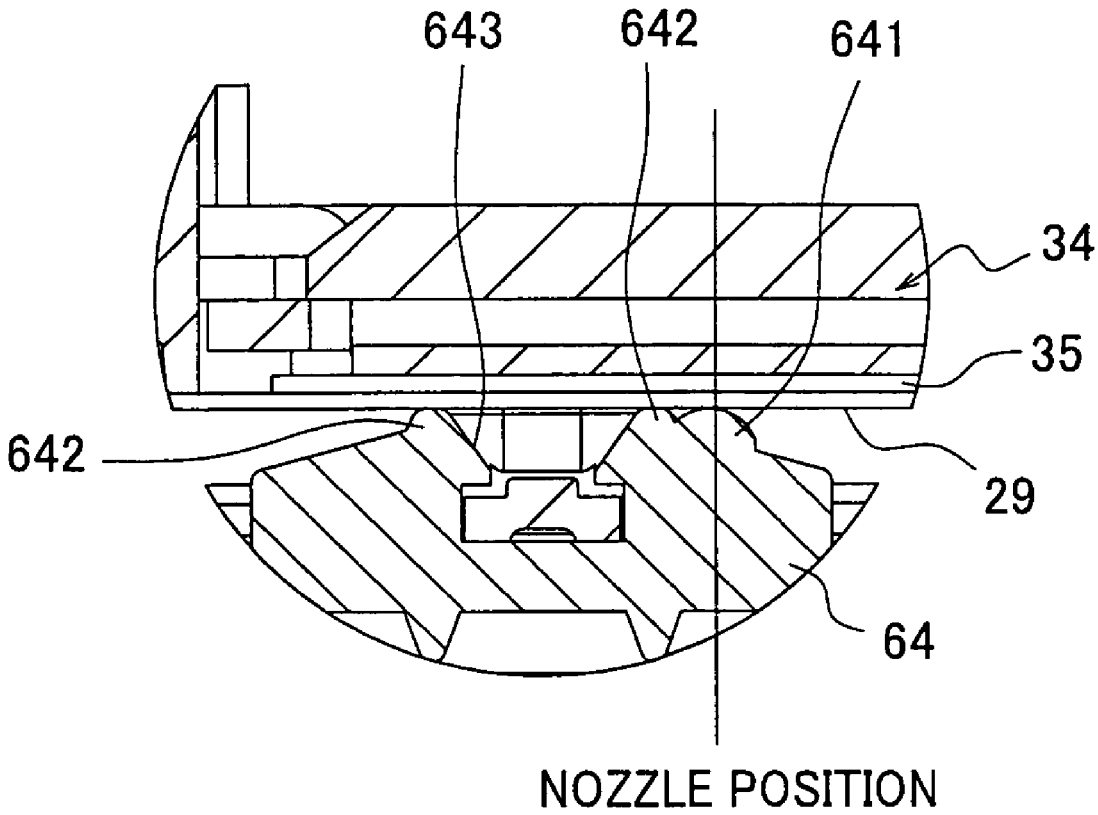
FIG. 30 is a cross-sectional view showing a modified form of a cap.

While, in the above-described embodiment, the surfaces of the sealing portions 641*a*, 641*b* are formed to be substantially flat, the surfaces of the sealing portions 641*a*, 641*b* may be formed to be convex toward the nozzles 33 as shown in FIG. 30. The surfaces of the sealing portions 641*a*, 641*b* having substantially flat configuration are likely to closely contact the entire nozzle surfaces 29, while the surfaces of the sealing portions 641*a*, 641*b* having a curved configuration convex toward the nozzles 33 are likely to tightly seal the openings of the nozzles 33.

Figure 31:
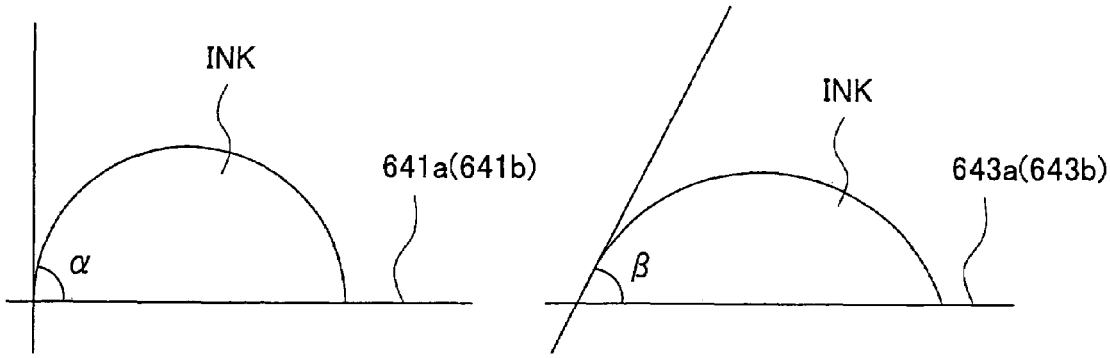
FIG. 31 is an explanatory view schematically showing the difference in the contact angles of ink against the surfaces of the sealing portion and the covering portion of a cap in a modified form, although showing here the configuration of the vicinity of only one of two caps with the omission of subscripts "a" and "b".

By applying water-repellent coating on the surface of the sealing portions 641*a*, 641*b*, by changing the surface roughness, or by using coinjection molding, the wettability of the surface of the sealing portions 641*a*, 641*b* with ink may be set lower than the wettability of the surface of the covering portions 643*a*, 643*b*. That is, the ink-repellency of the sealing portions 641*a*, 641*b* may be set higher than the ink-repellency of the covering portions 643*a*, 643*b*. Then, as shown in FIG. 31, the angle of contact $\alpha$ of the surface of the sealing portions 641*a*, 641*b* with an ink droplet will be larger than the angle of contact $\beta$ of the surface of the covering portions 643*a*, 643*b*, leading to the following effect: When the sealing portions 641*a*, 641*b* are detached from the openings of the nozzles 33 from a close contact state with each other, the ink is likely to flow to the covering portions 643*a*, 643*b* and is unlikely to remain on the surface of the sealing portions 641*a*, 641*b*. The ink which has flown to the covering portions 643*a*, 643*b* may be discharged through the suction ports 644*a*, 644*b* to the tubes 76*a*, 76*b* during recovery processing for selectively sucking ink.

Thus, when the standby state is changed to the long-time standby state, it is possible to sufficiently prevent adhesion of ink remaining on the surface of the sealing portions 641*a*, 641*b* to the nozzles 33. Furthermore, when the angle of contact of the sealing portions 641*a*, 641*b* with an ink droplet is 90 degrees or more, it is possible to securely prevent ink from leaking by capillary force into gaps between the nozzle surfaces 29 and the sealing portions 641*a*, 641*b* during the long-time standby state.

As clearly shown in FIGS. 21A through 21C, each of the caps 64*a*, 64*b* is provided with the covering portion 648*a* or 643*b* formed by being surrounded by the lip 642*a* or 642*b*, and with the sealing portion 641*a* or 641*b* on one side of and adjacent to the lip 642*a* or 642*b*. Instead, sealing portions may be provided on both sides of and adjacent to the lip 642*a* or 642*b*. Specifically, although the sealing portion 641 is provided on the right side of and adjacent to the right lip 642, as shown in FIGS. 21B and 21C, another sealing portion 641 may be provided on the left side of and adjacent to the left lip 642. Such a configuration does not require limitation on the moving direction of the carriage to only one direction when the carriage is controlled to move as shown in FIGS. 27 through 29, allowing an increase in the possibility of printer design. In this case, however, it will be necessary to increase the force of pressing the sealing portions 641 having a greater area onto the nozzle surface 29 of the recording head 34 in order to improve the sealing performance of the cap 64.

In addition, it is to be understood that the sealing portion 641, provided on the right side of and adjacent to the right lip 642 in FIGS. 21B and 21C, may be provided only on the left side of and adjacent to the left lip 642.

What is claimed is:

1. A cap for sealing a nozzle for discharging droplets of a liquid, comprising:

a sealing portion including a sealing surface that is adapted to directly seal an opening of the nozzle; and a covering portion having a lip adapted to continuously and closely contact a surrounding of the opening of the nozzle, the covering portion being adapted to form a sealed space on a surface formed with the opening of the nozzle by the close contact of the lip, wherein the sealing portion and the covering portion are integrally formed adjacent to each other, and wherein the sealing surface is distinct from the lip of the covering portion.

2. The cap according to claim 1, wherein a surface of the sealing portion to directly seal the opening of the nozzle has a substantially flat configuration.

3. The cap according to claim 1, wherein an angle of contact of a surface of the sealing portion with a droplet is larger than an angle of contact of a surface of the covering portion with a droplet.

4. The cap according to claim 1, wherein the covering portion includes a suction port through which the droplets discharged into the sealed space is sucked from an outside.

5. The cap according to claim 1, wherein the surface of the sealing portion to directly seal the opening of the nozzle has a width of about 1 mm to about 2 mm, and the lip of the covering portion adapted to closely contact the surrounding of the opening of the nozzle has a width of about 0.3 mm to about 0.5 mm.

6. The cap according to claim 1, wherein a width of the sealing surface of the sealing portion is greater than a width of the lip of the covering portion.

7. A droplet discharge apparatus comprising:

a head capable of selectively discharging droplets of a liquid from a nozzle;

a cap including:

a sealing portion that is adapted to directly seal an opening of the nozzle, and a covering portion having a lip that is adapted to continuously and closely contact a surrounding of the opening of the nozzle, the covering portion being adapted to form a sealed space on a surface formed with the opening of the nozzle by the close contact of the lip, wherein the sealing portion and the covering portion are integrally formed adjacent to each other;

a moving device that moves the cap relatively to the head in a predetermined direction in which the sealing portion and the covering portion are arranged adjacent to each other; and a control device that selects one of the sealing portion and the covering portion depending on a standby state in which the head does not discharge the droplets from the nozzle, drives the moving device to move the cap relatively to the head, and brings the sealing portion, if selected, to directly seal an opening of the nozzle or brings the covering portion, if selected, to closely contact a surrounding of the opening of the nozzle.

8. The droplet discharge apparatus according to claim 7, wherein the head includes a row of nozzles, wherein the sealing portion directly seals openings of the nozzles and the covering portion closely contacts the surrounding of the openings of the nozzles, and wherein the row of nozzles, the sealing portion, and the covering portion are arranged parallel to one another in a direction crossing the predetermined direction.

9. The droplet discharge apparatus according to claim 8, wherein the sealing portion has a linear shape elongated along the row of nozzles, and the lip of the covering portion has a substantially rectangular frame-like shape enclosing therein the row of nozzles.

10. The droplet discharge apparatus according to claim 7, wherein the head includes a plurality of rows of nozzles and the droplet discharge apparatus comprises a plurality of the cap comprising:

a sealing portion that directly seals an opening of the nozzle; and a covering portion having a lip continuously and closely contacting a surrounding of the opening of the nozzle, the covering portion being adapted to form a sealed space on a surface formed with the opening of the nozzle by the close contact of the lip, wherein the sealing portion and the covering portion are integrally formed adjacent to each other, wherein each of the caps is provided for a corresponding one of the rows of nozzles and has the sealing portion and the covering portion, wherein the rows of nozzles, the sealing portions, and the covering portions are arranged parallel to one another in a direction crossing the predetermined direction, and wherein a distance between the rows of nozzles, a distance between the sealing portions, and a distance between the covering portions are the same.

11. The droplet discharge apparatus according to claim 7, further comprising:

a time measuring device that measures an elapsed time since the start of close contact of the covering portion with the surrounding of the opening of the nozzle, wherein when the time measuring device has measured a predetermined elapsed time, the control device drives the moving device to move the cap relatively to the head and brings the sealing portion of the cap to directly seal the opening of the nozzle.

12. The droplet discharge apparatus according to claim 7, further comprising:

a pause instruction device that instructs the control device to pause, wherein when instructed to pause by the pause instruction device, the control device drives the moving device to move the cap relatively to the head, brings the sealing portion of the cap to directly seal the opening of the nozzle, and subsequently shifts to a pause state.

13. The droplet discharge apparatus according to claim 7, further comprising:

a power supply device that supplies power to the droplet discharge apparatus; and a temporary power supply device that temporarily supplies power to the droplet discharge apparatus when power supply by the power supply device is stopped, wherein when power supply by the power supply device is stopped, the control device drives the moving device to move the cap relatively to the head and brings the sealing portion of the cap to directly seal the opening of the nozzle by using power supplied by the temporary power supply device.

14. The droplet discharge apparatus according to claim 7, further comprising:

a pressure applying device that applies a positive pressure to the liquid in the nozzle;

wherein the control device drives the pressure applying device to apply a positive pressure to the liquid in the nozzle when the opening of the nozzle is sealed with the sealing portion, drives the moving device to move the cap relatively to the head, and subsequently brings the covering portion to closely contact the surrounding of the opening of the nozzle.

15. The droplet discharge apparatus according to claim 7, further comprising:

a buffer tank that supplies the liquid to the head; and an air removal device that discharges air collected in the buffer tank, wherein the control device switches between a first processing and a second processing, and in the first processing, the sealing portion of the cap is brought to directly seal the opening of the nozzle or the covering portion of the cap is brought to closely contact the surrounding of the opening of the nozzle, and in the second processing, the air removal device is connected to the buffer tank to discharge the air collected in the buffer tank to an outside with the cap detached from the opening of the nozzle.

16. The droplet discharge apparatus according to claim 7, further comprising a suction device, wherein the covering portion includes a suction port, and the control device drives the suction device to suck the droplets discharged into the sealed space through the suction port when the covering portion is in close contact with the surrounding of the opening of the nozzle.

17. The droplet discharge apparatus according to claim 7, further comprising an elevating device that moves the cap relatively to the head in a direction perpendicular to the predetermined direction, wherein the control device drives the elevating device to move the cap relatively to the head, and brings the sealing portion, if selected, to directly seal the opening of the nozzle or brings the covering portion, if selected, to closely contact the surrounding of the opening of the nozzle.

* * * * *